US006223004B1

(12) United States Patent
Kodama

(10) Patent No.: US 6,223,004 B1
(45) Date of Patent: Apr. 24, 2001

(54) IMAGE FORMING APPARATUS HAVING IMAGE TRANSFER CONTROL

(75) Inventor: Hideaki Kodama, Okazaki (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/310,834

(22) Filed: May 12, 1999

Related U.S. Application Data

(62) Division of application No. 08/970,331, filed on Nov. 14, 1997, now Pat. No. 6,058,275.

(30) Foreign Application Priority Data

Nov. 14, 1996 (JP) ..... 8-302753
Nov. 14, 1996 (JP) ..... 8-302760
Nov. 14, 1996 (JP) ..... 8-302761

(51) Int. Cl.[7] ..... G03G 15/00; G03G 15/06

(52) U.S. Cl. ..... 399/44; 399/45; 399/55; 399/66

(58) Field of Search ..... 399/44, 45, 55, 399/66, 53

(56) References Cited

U.S. PATENT DOCUMENTS 5,608,506 * 3/1997 Omoto ..... 399/45 X
5,761,568 * 6/1998 Haragakiuchi et al. ..... 399/44
5,799,226 8/1998 Shigeta et al. ..... 399/66
5,983,044 * 11/1999 Kodama et al. ..... 399/55 X

FOREIGN PATENT DOCUMENTS 4-149464 5/1992 (JP) .

* cited by examiner

*Primary Examiner*—William J. Royer
(74) *Attorney, Agent, or Firm*—Sidley & Austin

(57) ABSTRACT

An image forming apparatus using an electrophotographic process is disclosed which measures the resistance of a page onto which an image is to be formed and optionally also measures the humidity of ambient environment. A controller controls image forming conditions, such as a development condition or a transfer condition, according to the measured resistance and/or the measured humidity.

14 Claims, 22 Drawing Sheets

IMAGE FORMING APPARATUS HAVING IMAGE TRANSFER CONTROL

RELATED APPLICATION

This application is a division of then application Ser. No. 08/970,331, filed Nov. 14, 1997, now U.S. Pat. No. 6,058,275, which claims priority from Japanese Patent Application No. 8-302753, filed Nov. 14, 1996, Japanese Patent Application No. 8-302760, filed Nov. 14, 1996, and Japanese Patent Application No. 8-302761, filed Nov. 14, 1996, each of which is hereby incorporated by reference in its entirety.

BACKGROUND OF THE INVENTION

1. Field of the Invention

The present invention relates to an image forming apparatus such as a copying machine using an electrophotographic process.

2. Description of Prior Art

For an image forming apparatus such as a copying machine using an electrophotographic process, it is desirable to reproduce an image of the same density for the same image data. In order to reproduce an image of stabilized density on a paper, it is known to form a standard toner image. When a copy operation is started or when a predetermined mode is set, a standard toner image is formed on a photoconductor, and the transfer efficiency of the toner image onto the paper is detected. Then, development or transfer conditions are controlled according to the detected results.

However, the above-mentioned stabilization is not controlled appropriately in cases, for example, when toners are deteriorated or when the resistance of a paper on which a toner image is transferred becomes lower than expected by absorbing water content from the humidity of ambient environment. Even if toners have been charged normally, they are charged with the reverse polarity at a transfer section in a copying machine, and the amount of toners remaining on the photoconductor increases after passing the transfer section in the copying machine, so that the transfer efficiency becomes worse. Further, if toners are deteriorated, the amount of charges of toners after development and before transfer becomes lower. Toners are also charged with the reverse polarity at the transfer section in this case, so that the transfer efficiency becomes worse.

SUMMARY OF THE INVENTION

An object of the present invention is to provide an image forming apparatus which performs stable transfer irrespective of the state of a paper and toners.

In a first aspect of the invention, an image forming apparatus using an electrophotographic process comprises a photoconductor for forming a latent image, a development device for developing the latent image to form a toner image, and a transfer device for transferring the toner image onto a paper passing between the photoconductor and the transfer device. A measuring device measures an electrostatic capacitance between said photoconductor and said transfer device in predetermined conditions while a standard toner image is formed, and a controller controls image forming conditions, such as a development condition or a transfer condition, according to the measured electrostatic capacitance. Preferably, humidity of ambient environment is measured and the image forming conditions are controlled according to the electrostatic capacitance and the humidity.

In a second aspect of the invention, in an image forming apparatus using an electrophotographic process, a resistance of the paper is measured, and a controller controls image forming conditions according to the measured resistance.

In a third aspect of the invention, in an image forming apparatus using an electrophotographic process, a measuring device measures an amount of toner charges of a standard toner image, and a controller controls image forming conditions according to the measured amount of toner charges.

An advantage of the present invention is that transfer conditions can be controlled appropriately.

Another advantage of the present invention is that development conditions can be controlled appropriately.

A further advantage of the present invention is that reverse charging of toners at the transfer can be prevented.

BRIEF DESCRIPTION OF THE DRAWINGS

These and other objects and features of the present invention will become clear from the following description taken in conjunction with the preferred embodiments thereof with reference to the accompanying drawings, and in which.

DETAILED DESCRIPTION OF THE PREFERRED EMBODIMENTS

Figure 1:
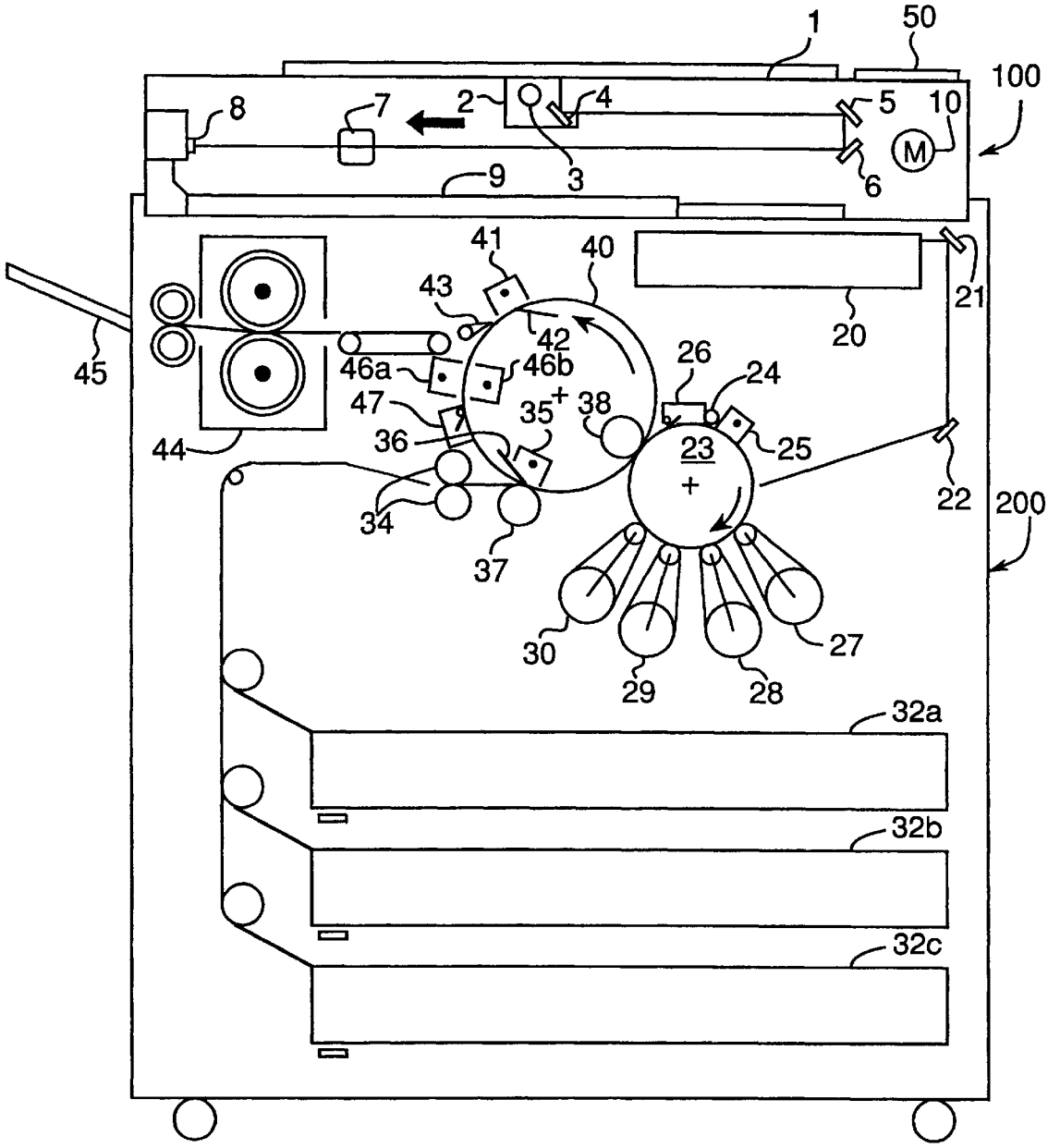
FIG. 1 is a schematic sectional view of a digital full color copying machine of a first embodiment of the invention.

Referring now to the drawings, wherein like reference characters designate like or corresponding parts throughout the views, embodiments according to the invention are explained.

FIG. 1 shows a digital full color copying machine of a first embodiment of the invention. The copying machine comprises an image reader 100 for reading a document image and a printer 200 for forming an image on a paper according to the document image read by the image reader 100.

In the image reader 100, a document put on a platen glass 1 is illuminated by a lamp 3 mounted to a scanner 2. A light is reflected by the document and propagates though mirrors 4, 5 and 6 and a focus lens 7 to be focused onto a CCD line sensor 8. The scanner 2 is moved by a motor 10 along a direction of an arrow shown in FIG. 1 (or along subscan direction) at a speed V in correspondence to a magnifying power. Thus, the document is scanned over the whole face thereof. The mirrors 5 and 6 are also moved at a speed of V/2 in the same direction. Multi-level electrical signals of R, G and B obtained by the CCD line sensor 8 are converted to 8-bit gradation data by a read signal processor 9 to be output to the printer 200.

Further, an operational panel 50 is provided at the top of the image reader 100 for setting copy conditions such as a copy number and for executing copy operation. The operational panel 50 has keys (not shown) for setting image forming conditions. When a key (not shown) for adjustment of image forming conditions is pressed, the adjustment is performed as will be explained later.

In the printer 200, a print head 20 produces signals for driving a laser diode on the basis of the gradation signals received from the read signal processor 9, and the laser diode in the print head 20 emits a laser beam according to the driving signals. The laser beam emitted from the print head 20 propagates through mirrors 21 and 22 to scan the is surface of a photoconductor drum 23 which is rotated. Before each exposure, the surface of the photoconductor drum 23 has been illuminated with an eraser lamp 24 and charged uniformly with a sensitizing charger 25. When the photoconductor drum is subjected to exposure, an electrostatic latent image of the document is formed on the photoconductor drum 23. Among the toner development units 27–30 of cyan, magenta, yellow and black, the toner development unit 27 for cyan is selected first, and the electrostatic latent image on the photoconductor drum 23 is developed. An appropriate paper has been carried from one of paper cassettes 32A, 32B and 32C to a pair of timing rollers 34, and the timing rollers 34 feed the paper toward a transfer drum 40 at a timing so that the top of the toner image developed on the photoconductor drum 23 corresponds to the top of the paper. The paper is electrostatically attracted to the transfer drum 40 with an attraction charger 35 and an attraction roller 37. A press member 36 makes the paper contact the transfer drum 40 and presses the transfer drum 40 toward the attraction roller 37 for stronger attraction. The cyan toner image is transferred onto the paper wound on the transfer drum 40 by applying a predetermined electrical voltage through a transfer film of the transfer drum 40 to the transfer roller 38 made of a metal. After the toner image is transferred, toners remaining on the photoconductor drum 23 are removed with a cleaner 26. Thus, the cyan toner image has been transferred. This process is repeated for the other toners. That is, one of the other toner development units of magenta, yellow and black is selected successively, and charging, exposure and toner development on the photoconductor drum 23 are performed. The toner images of the colors developed on the photoconductor drum 23 are overlap each other on the paper wound on the transfer drum 40. The paper, on which toner images of the four colors are transferred is discharged by a charger 41 for separation and discharging, and it is pressed up by a further press member 42 to engage the top of the paper with a claw 43. Then, the paper is separated from the surface of the transfer drum 40. The separated paper passes through a fixing unit 44 for fixing the image, and it is discharged onto a tray 45.

The resistance value of the paper and the toner charges (or the amount of charges of toners) affect the transfer efficiency when the visual toner image on the photoconductor drum 23 is transferred onto a paper. Next, characteristics of the paper and the toner charges are explained.

Figure 2:
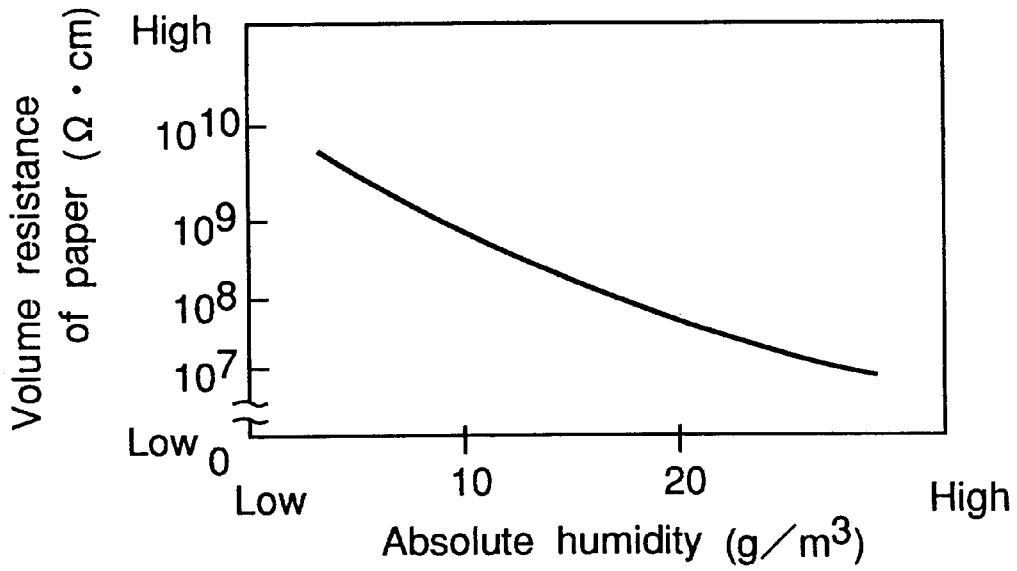
FIG. 2 is a graph of a relation between volume resistance value (Ω·cm) and absolute humidity (g/cm$^3$)
Figure 3:
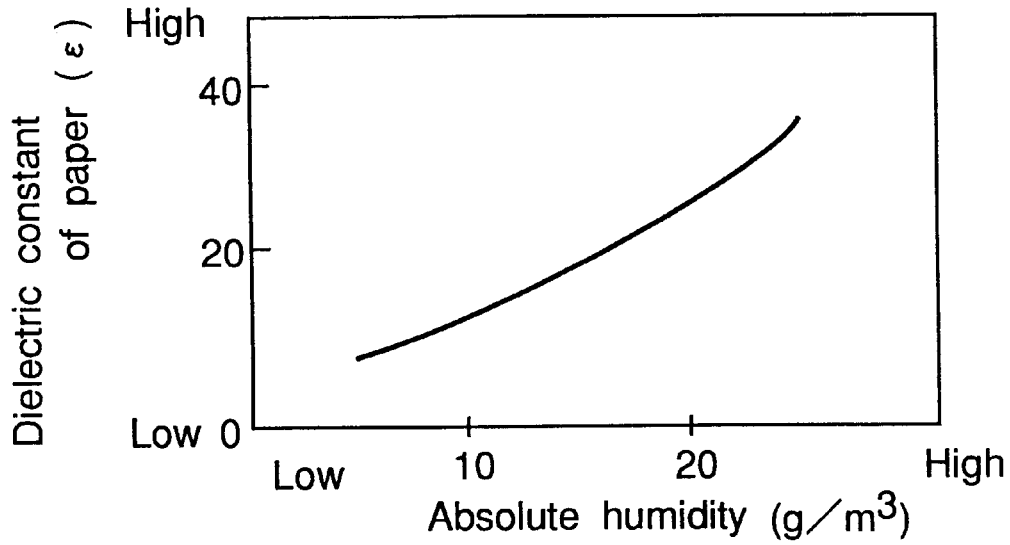
FIG. 3 is a graph of a relation between dielectric constant ∈ and absolute humidity (g/cm$^3$)

When a paper absorbs water or it is dried in an ambient environment, electrical properties thereof are changed. FIG. 2 shows a graph of volume resistance value ($\Omega\cdot$cm) plotted against absolute humidity (g/c$^3$). This shows that the volume resistance of paper decreases with increasing absolute humidity. Further, FIG. 3 shows dielectric constant $\in$ plotted against absolute humidity (g/cm$^3$). This shows that the dielectric constant $\in$ increases with increasing absolute humidity or with increasing volume resistance of paper.

Figure 4:
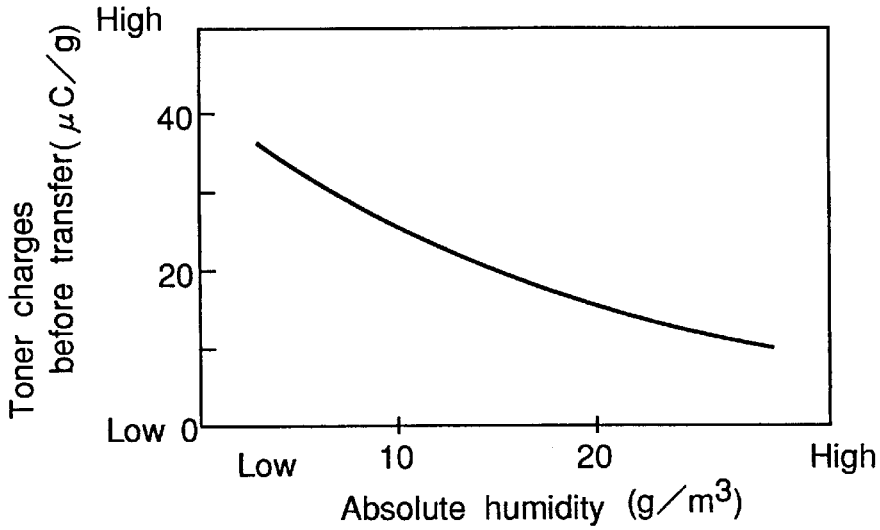
FIG. 4 is a graph of a relation between toner charges before transfer ($\mu$C/g) and absolute humidity (g/cm$^3$)

Further, the charges of toners before transfer onto a paper also depend on humidity. FIG. 4 shows a graph of toner charges before transfer ($\mu$C/g) plotted against absolute humidity (g/cm$^3$). This shows that the toner charges before transfer decrease with increasing absolute humidity.

Figure 5:
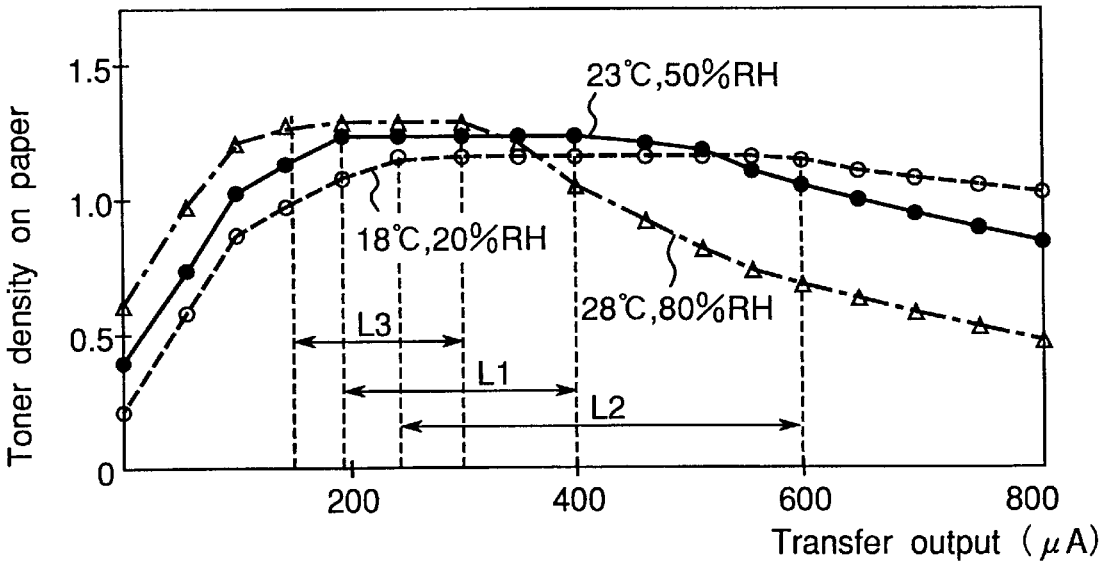
FIG. 5 is a graph of transition of toner density when an image is formed under various transfer outputs in three environments after the apparatus has been left in the environments for seven to eight hours.

FIG. 5 shows a graph of transition of toner density when an image is formed under various transfer outputs in three environments after the apparatus has been left in the environments for seven to eight hours for the apparatus to get used to the environments. A solid line in the graph shows a characteristic in an environment of a temperature of 23° C. and a humidity of 50%RH. The transfer efficiency becomes the best and the toner density on the paper becomes the largest in a range L1 of transfer output. The toner density decreases gradually after the transfer output increases above about 400 μA. A dashed line in the graph shows a characteristic in an environment of a temperature 18° C. and a humidity of 20%RH. The increase rate of toner density due to increase in transfer output becomes lower than in the case of a humidity 50%RH, and the value of transfer output for the best transfer efficiency or for the maximum toner density becomes larger. The toner density on the paper becomes the largest in a range L2 of transfer output. The toner density decreases after the transfer output increases above about 550 μA, more gradually than in the case of a humidity of 50%RH. A dot and dashed line in the graph shows a characteristic in an environment of a temperature of 28° C. and a humidity of 80%RH. The increase rate of toner density due to increase in transfer output becomes higher than in the case of a humidity of 50%RH, and the toner density increases sharply. The toner density on the paper becomes the largest in a range L3 of transfer output of 100 to 200 μA. The toner density decreases after the transfer output increases above about 200 μA, more sharply than in the case of a humidity of 50%RH. As will be understood from the three characteristics, if humidity is high, the increase rate of toner density due to increase in transfer output becomes higher, and the decrease rate after reaching the maximum density also becomes higher. On the other hand, if humidity is low, the increase rate of toner density due to increase in transfer output becomes lower, and the decrease rate after reaching the maximum density also becomes lower. Further, the range of transfer output wherein the transfer efficiency becomes the best or the toner density becomes maximum becomes wider with decreasing humidity.

Figure 6:
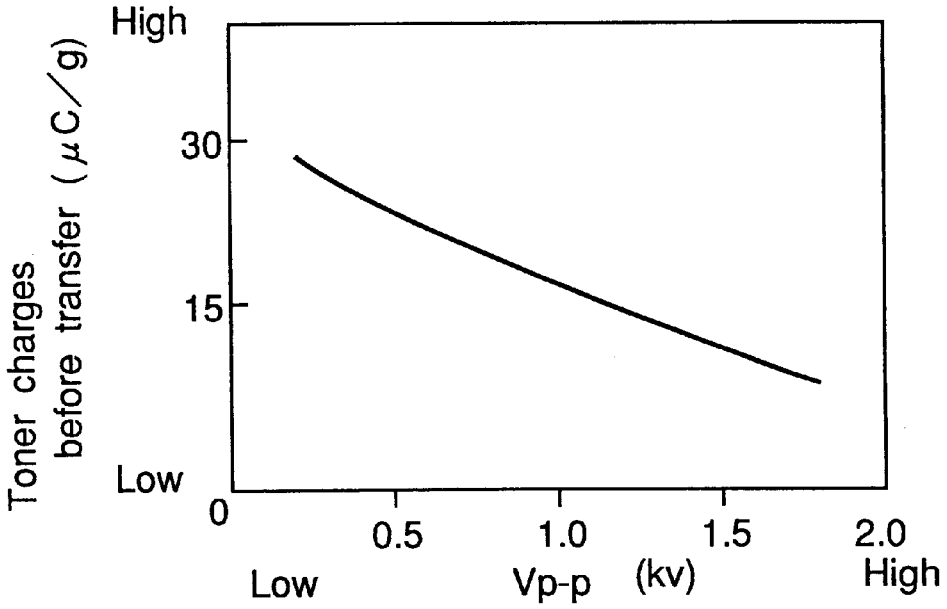
FIG. 6 is a graph of toner charges just before transfer plotted against peak-to-peak voltage $V_{p\text{-}p}$.

Further, the appropriate output transfer range for high humidity is explained with reference to FIG. 6. When the humidity becomes higher, to say 80%RH, as shown in FIG. 5, the range of transfer output wherein the toner density becomes the maximum becomes much narrower than in the case of 20%RH. This is ascribed to a lower transfer output where the toner density starts to decrease with increasing transfer output. As shown in FIG. 4, under high humidity environment, toner charges decrease and toners are charged with the reverse polarity by the transfer roller 38, remaining on the photoconductor drum 23 without being transferred onto the paper. This causes toner density decrease at high output side. The reverse charging can be prevented by increasing the toner charges to some degree. As shown in FIG. 2, the resistance of paper also decreases with increasing humidity. However, if the resistance is sufficiently high, the transfer output can be lowered, and the reverse charging of toners can be suppressed.

Figure 7:
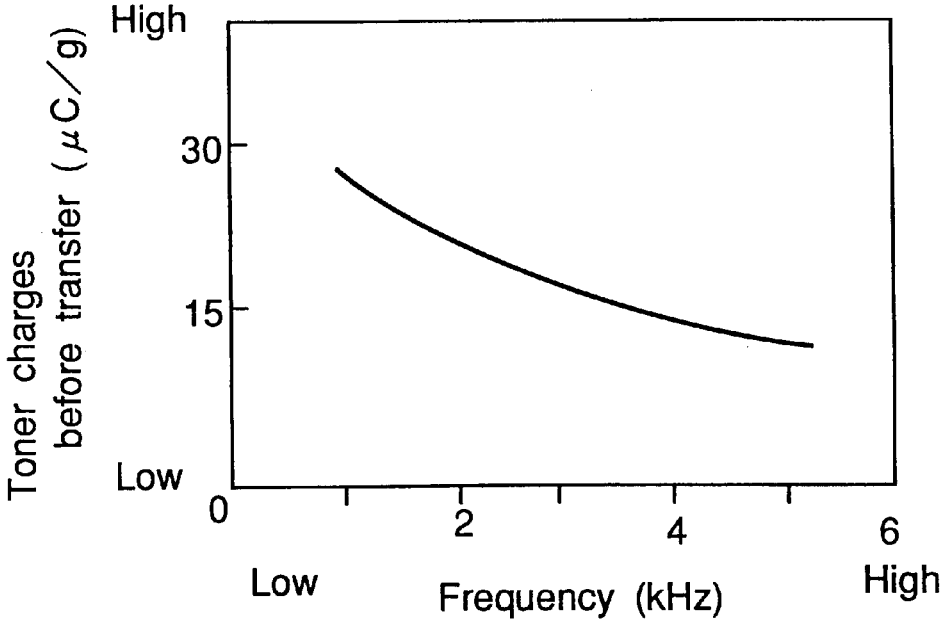
FIG. 7 is a graph of toner charges just before transfer plotted against frequency.

Next, a relation is explained between development bias voltage and toner charges before transfer. When a latent image is developed with toners by a development unit, the development bias voltage is applied to the surface of a development sleeve in the development unit. The development bias voltage may be a dc current or have an ac voltage superposed thereon. In the latter case, the ac voltage is mainly a sine wave or a rectangular wave. The amount of charges of toners on the photoconductor drum 23 just before transfer depends largely on the value of superposed ac voltage and its frequency. As an example, FIG. 6 shows a change in the toner charges just before transfer when an ac voltage of sine wave is applied as development bias voltage for various peak-to-peak voltages $V_{p-p}$, and FIG. 7 shows a change in the toner charges just before transfer when frequency f is changed in the above case. As shown in FIGS. 6 and 7, the toner charges decrease with increasing voltage $V_{p-p}$ or with increasing frequency f.

Figure 8:
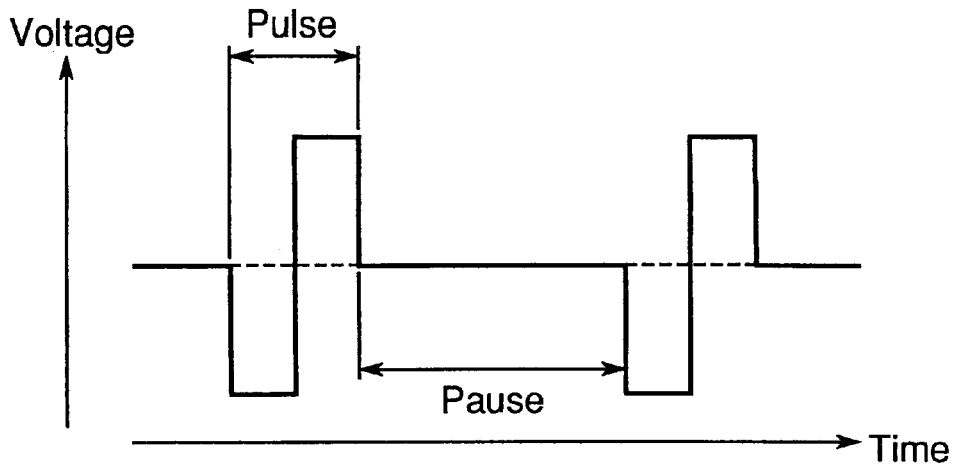
FIG. 8 is a diagram of a pulse wave having a pause time.
Figure 9:
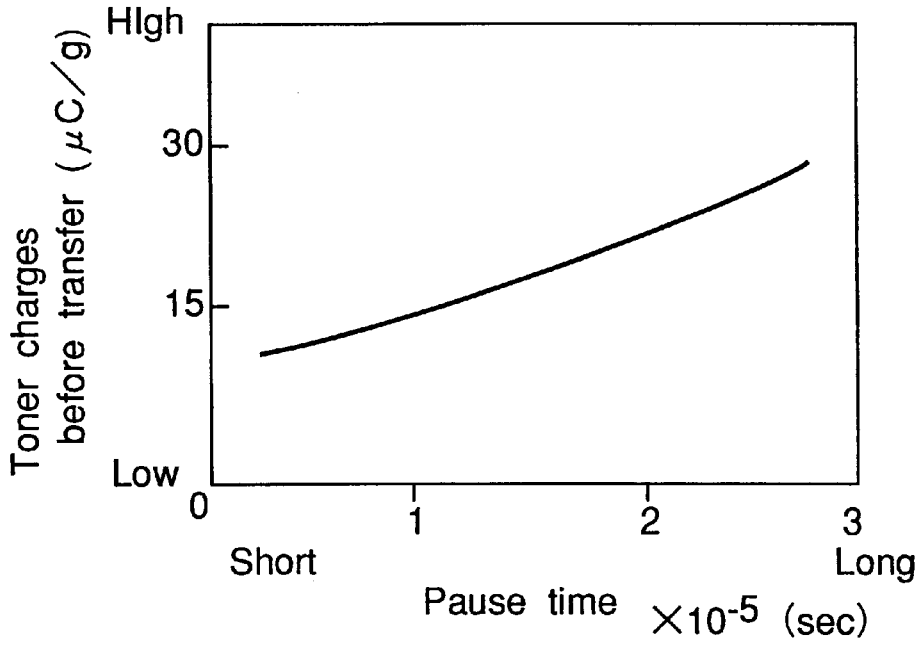
FIG. 9 is a graph of toner charges just before transfer plotted against pause time.
Figure 10:
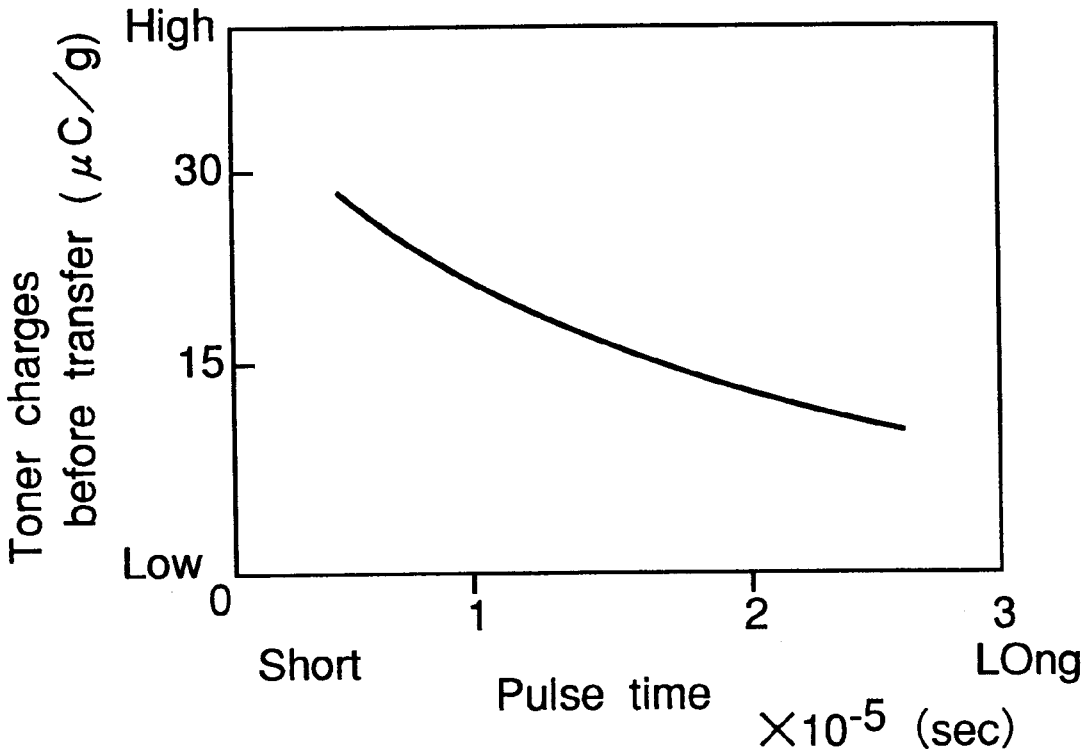
FIG. 10 is a graph of toner charges just before transfer plotted against pulse time.

As shown in FIG. 8, the development bias voltage may be a pulse wave including a pulse time and a pause time in a period, instead of a rectangular wave. FIG. 9 shows a change in the toner charges just before transfer when the pause time is changed, and FIG. 10 shows a change in the toner charges before transfer when the pulse time is changed. As shown in FIG. 9, the toner charges before transfer increase with increasing pause time, and as shown in FIG. 10, the toner charges before transfer decrease with increasing pulse time.

Figure 11:
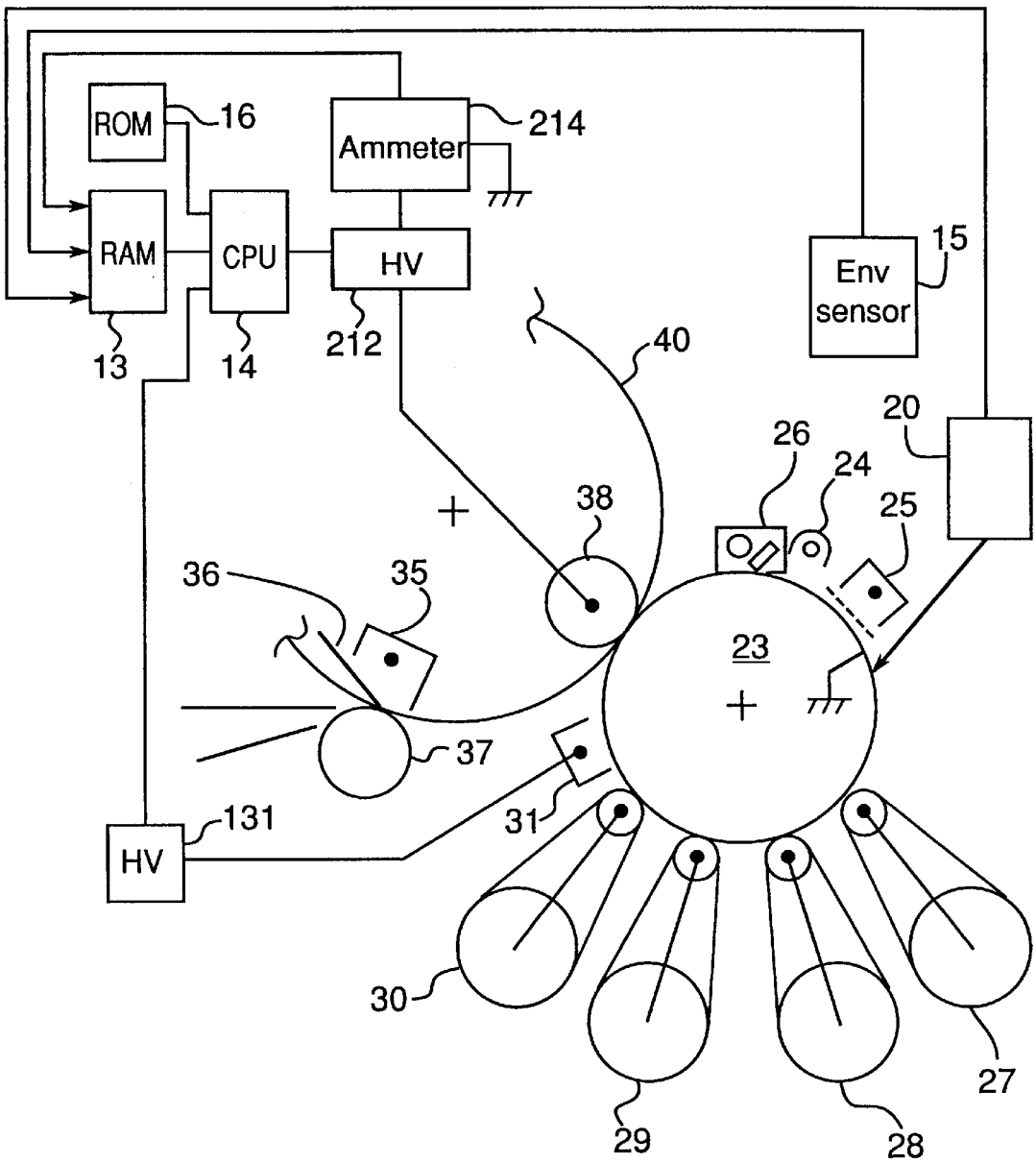
FIG. 11 is a schematic diagram of a structure around a photoconductor drum and a transfer drum in the copying machine.

FIG. 11 shows in detail a structure around the photoconductor drum 23 and the transfer drum 40 in the copying machine and a control system therefor. The control system has a central processing unit (hereinafter referred to as CPU) 14. A read only memory (ROM) 16 connected to the CPU 14 stores data of control tables to be explained below, and a random access memory (RAM) 13 connected to the CPU 14 stores data temporarily necessary for the control. A high voltage power supply 212 is connected to the transfer roller 38 for applying a predetermined voltage thereto, and the CPU 14 controls the voltage generated by the power supply 212. A pretransfer charger 31 (which is not shown in FIG. 1) is located just before a transfer section for increasing toner charges just before transfer. A charge wire current flowing through the pretransfer charger 31 is fixed at 300 μA, and the grid voltage applied thereto is controlled by another high voltage power supply 131 if necessary. The CPU 14 controls the voltage generated by the power supply 131.

In normal copy operation, the CPU 14 detects absolute humidity of the printer 200 with an environment sensor (including a humidity sensor) 15, and changes the voltage applied to the transfer roller 38 according to the detection in order to keep the transfer efficiency constant. Table 1 is a control table stored in the ROM 16 for determining the applied voltage (transfer output) in correspondence to absolute humidity. The control table is used when a full color image is formed. As shown in Table 1, the applied voltage is set to increase with decreasing absolute humidity. For each section of absolute humidity, the applied voltage is increased successively for the first color (cyan), the second color (magenta), the third color (yellow) and the fourth color (black). This takes into account an effect of charge-up of the transfer film due to the output of a previous color.

TABLE 1

Control table of transfer output

| Absolute humidity ($g/m^3$) | Transfer output (kV) First color (cyan) | Second color (magenta) | Third color (yellow) | Fourth color (black) |
|---|---|---|---|---|
| 0–5 | 3.8 | 4.0 | 4.2 | 4.4 |
| 6–10 | 3.6 | 3.8 | 4.0 | 4.2 |
| 11–15 | 3.4 | 3.6 | 3.8 | 4.0 |
| 16–20 | 3.2 | 3.4 | 3.6 | 3.8 |
| 21–25 | 3.0 | 3.2 | 3.4 | 3.6 |
| 26–30 | 2.8 | 3.0 | 3.2 | 3.4 |

When the key for adjustment is pressed in the operational panel 50, the CPU 14 determines the electrostatic capacitances of the paper and the toner layer according to the current flowing the transfer section, and decides whether the toner charges just before transfer become smaller than the predetermined value and whether the resistance value of paper becomes lower. If the toner charges just before transfer is decided to be smaller than the appropriate value, the grid voltage of the pretransfer charger 31 is increased in order to enhance the toner charges. On the other hand, if the electrostatic capacitances of the paper and the toners are determined to be inappropriate, the voltage applied to the transfer roller 38 is decreased by a predetermined amount. Thus, the amount of toners remaining on the photoconductor drum due to the reverse charging at the transfer section is decreased.

Figure 12:
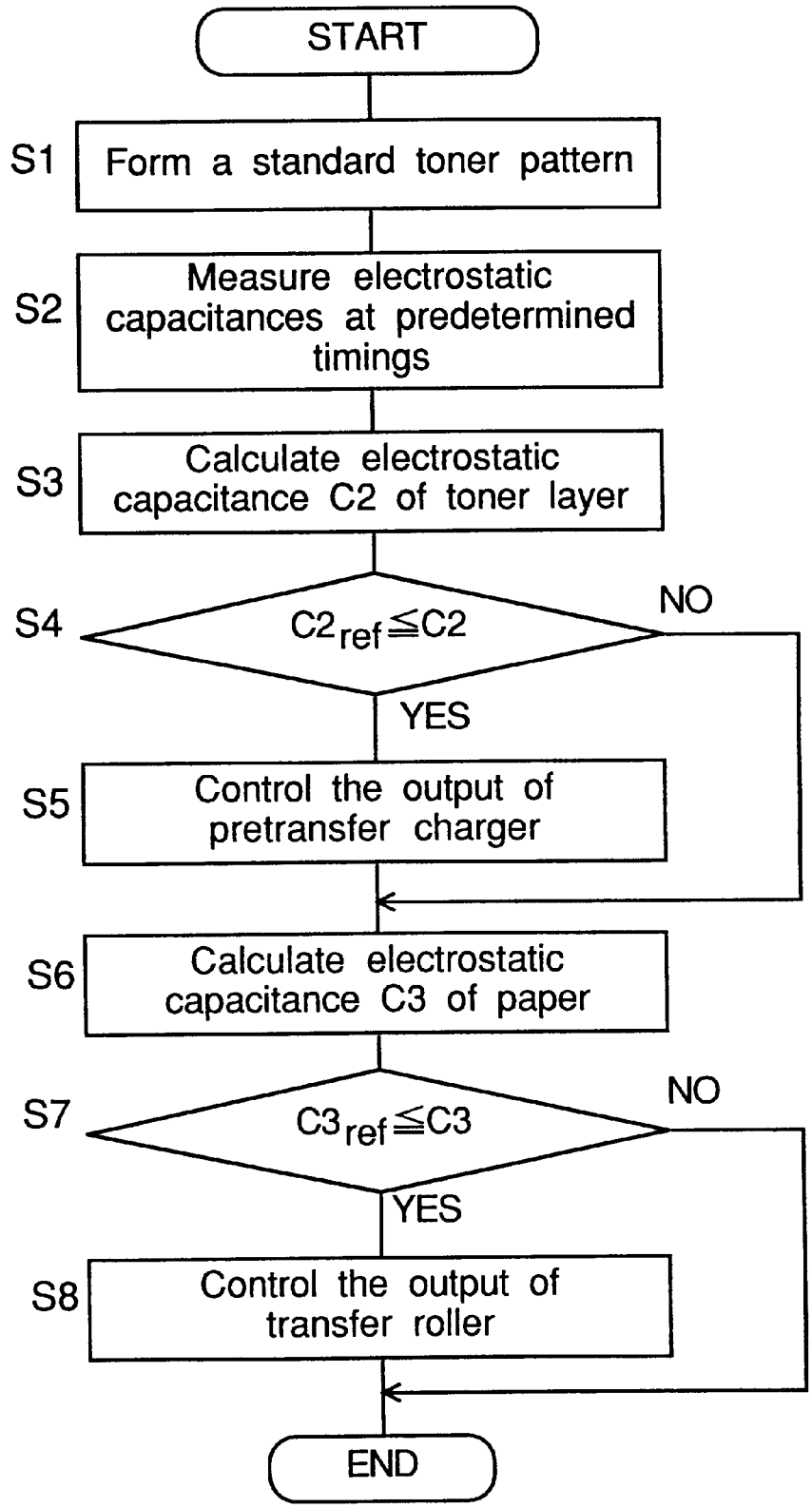
FIG. 12 is a flowchart for transfer output adjustment.
Figure 13C:
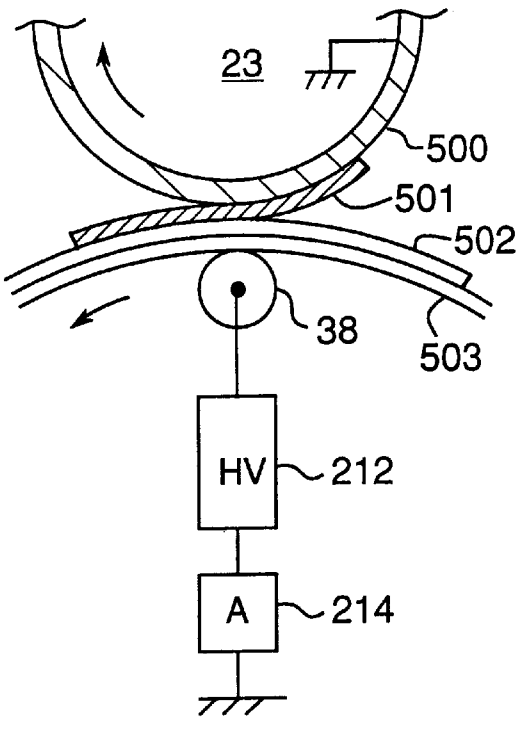
FIG. 13C is a diagram of a situation where a toner layer, the paper and the transfer film exist between the transfer roller and the photoconductor drum.
Figure 13B:
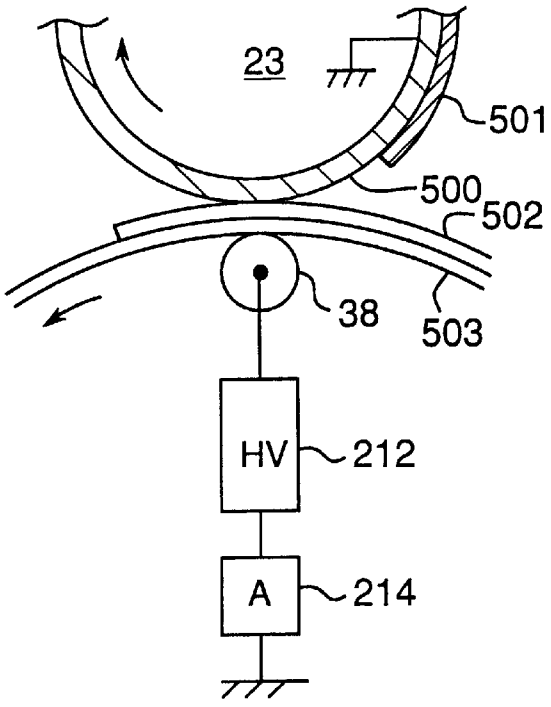
FIG. 13B is a diagram of a situation where the paper and the transfer film exist between a transfer roller and the photoconductor drum.
Figure 13A:
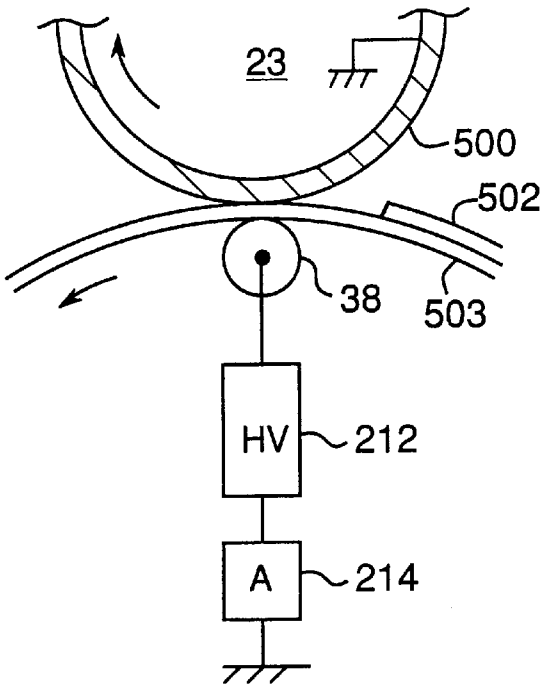
FIG. 13A is a diagram of a situation where a paper does not yet reach to the transfer section or only a transfer film exists between a transfer roller and a photoconductor drum.
Figure 14:
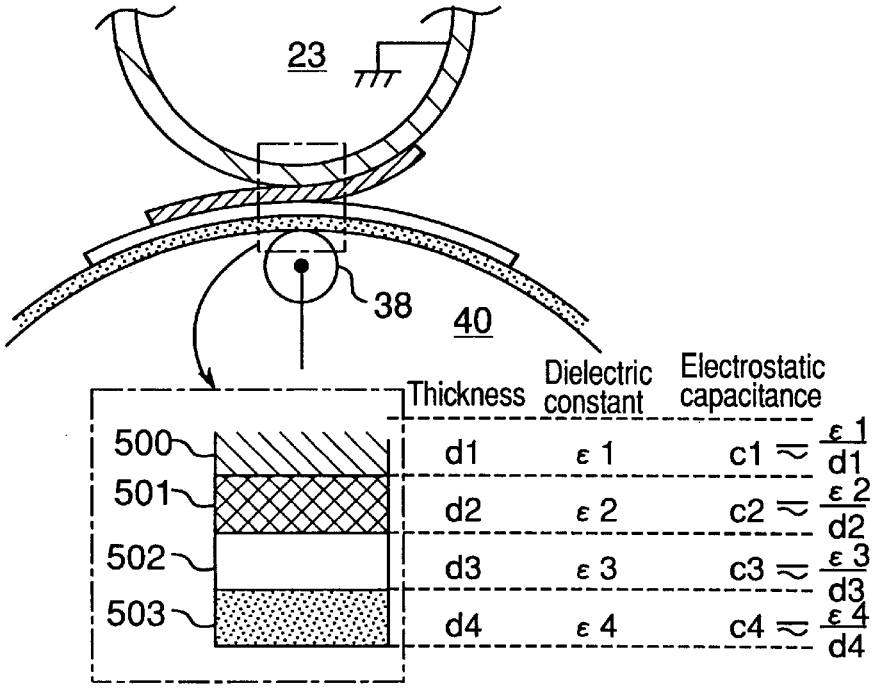
FIG. 14 is a diagram of a photoconductor dielectric layer, a toner layer, a paper and a transfer film between the photoconductor drum and the transfer roller.

FIG. 12 shows a flowchart executed by the CPU 14 when the key for adjustment is pressed in the operational panel 50. The content of the processing is explained in detail with reference to the flowchart and relevant drawings. First, a standard toner pattern is formed on the photoconductor drum 23 at position in correspondence to a second half of a paper fed to the transfer drum 40 with predetermined laser exposure intensity, grid voltage and development bias voltage (step S1). Then, the transfer roller 38 starts to apply a predetermined voltage just before the top end of the paper wound on the transfer drum reaches to the transfer section and stops applying the voltage after the bottom end of the paper passes the transfer section. FIG. 13A shows a situation where the paper 502 has not yet reached the transfer section or only the transfer film 503 exists between the transfer roller 38 and the photoconductor drum 23. FIG. 13B shows a situation where the paper 502 and the transfer film 503 exist between the transfer roller 38 and the photoconductor drum 23. FIG. 13C shows a situation where a toner layer 501, the paper 502 and the transfer film 503 exist between the transfer roller 38 and the photoconductor drum 23. The electrostatic capacitance is measured at the three timings shown in FIGS. 13A–13C according to the current measured with the ammeter 214 (step S2). FIG. 14 shows a diagram of a photoconductor dielectric layer 500, a toner layer 501, a paper 502 and the transfer film 503 between the photoconductor drum 23 and the transfer roller 38. Further, FIG. 14 also shows the thickness d, the dielectric constant $\in$ and the electrostatic capacitance C of the four layers 500–503. The current flowing the ammeter 214 depends on the electrostatic capacitances C1, C2, C3 and C4 of the photoconductor dielectric layer 500, the toner layer 501, the paper 502 and the transfer film 503. The electrostatic capacitance per unit area is proportional to a ratio of dielectric constant $\in$ to the thickness d. That is, the current depends on the thickness d1–d4 and the dielectric constant $\in$1–$\in$4. In this apparatus, the transfer film 503 is made of an insulating film of volume resistance of $10^{14}$–$10^{15}$ Ω·cm. Therefore, when a voltage is applied to measure the current, charges are moved only due to polarization of each phase, and free charges do not flow substantially. Therefore, the total electrostatic capacitance for capacitors of the layers connected in series can be determined from the measured current.

In the situation of FIG. 13A, the capacitance $C_a$ of the photoconductor dielectric layer 500 and the transfer film 503 connected in series is measured. In the situation of FIG. 13B, the capacitance $C_b$ of the photoconductor dielectric layer 500, the paper 502 and the transfer film 503 connected in series is measured. In the situation of FIG. 13C, the capacitance $C_c$ of the photoconductor dielectric layer 500, the toner layer 501, the paper 502 and the transfer film 503 connected in series is measured. As shown in FIG. 14, if C1, C2, C3 and C4 represent capacitances of the photoconductor dielectric layer 500, the toner layer 501, the paper 502 and the transfer film 503, the above-mentioned $C_a$, $C_b$ and $C_c$ satisfy the following relations:

$$C_a^{-1}=C_1^{-1}+C_4^{-1}, \tag{1}$$

$$C_b^{-1}=C_1^{-1}+C_3^{-1}+C_4^{-1}, \tag{2}$$

and $$C_c^{-1}=C_1^{-1}+C_2^{-1}+C_3^{-1}+C_4^{-1}. \tag{3}$$

Figure 15:
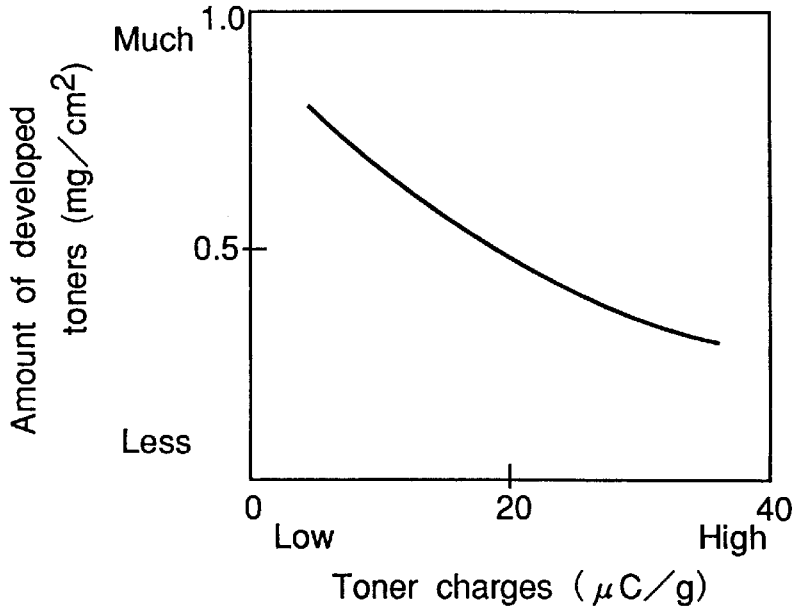
FIG. 15 is a graph of the amount of developed toners plotted against toner charges.

The standard patterns are formed in the same exposure conditions and the development conditions. The dielectric constant of toners does not change much due to absolute humidity. On the other hand, the toner charges just before transfer decreases with increasing absolute humidity as shown in FIG. 4. Therefore, as shown in FIG. 15, the toner charges developed on the photoconductor are changed according to the absolute humidity. Then, the thickness d2 of the toner layer 501 is changed when the electrostatic capacitance is measured, and the electrostatic capacitance has changed. Then, the amount of charges of toners can be measured indirectly by measuring the electrostatic capacitance of the toner layer. Thus, the electrostatic capacitance C2 of the toner layer 501 is determined according to the electrostatic capacitances measured at step S2 (step S3), as shown below.

$$C2=(C_c^{-1}-C_b^{-1})^{-1}. \tag{4}$$

If the obtained electrostatic capacitance C2 of the toner layer 501 is equal to or larger than a reference value $C2_{ref}$ (=20 pf) (YES at step S4), the charges of developed toners (just before transfer) is low and the toners are liable to be charged with the reverse polarity by the transfer output or to remain on the photoconductor drum 23. Then, the grid voltage of the pretransfer charger 31 is increased by a predetermined value from the normal value to enhance the toner charges (step S5). Specifically the grid potential of the charger 31 is determined by referring to the control table shown in Table 2 stored in the ROM 16. If the obtained electrostatic capacitance C2 of the toner layer 501 is smaller than the reference $C2_{ref}$ (NO at step S4), the grid voltage of the pretransfer charger 31 is not controlled.

TABLE 2

| Grid voltage of charger | |
|---|---|
| C2 (pf) | Grid voltage of charger |
| 0–20 | 0 |
| 21–40 | 350 |
| 41–60 | 700 |

Figure 16:
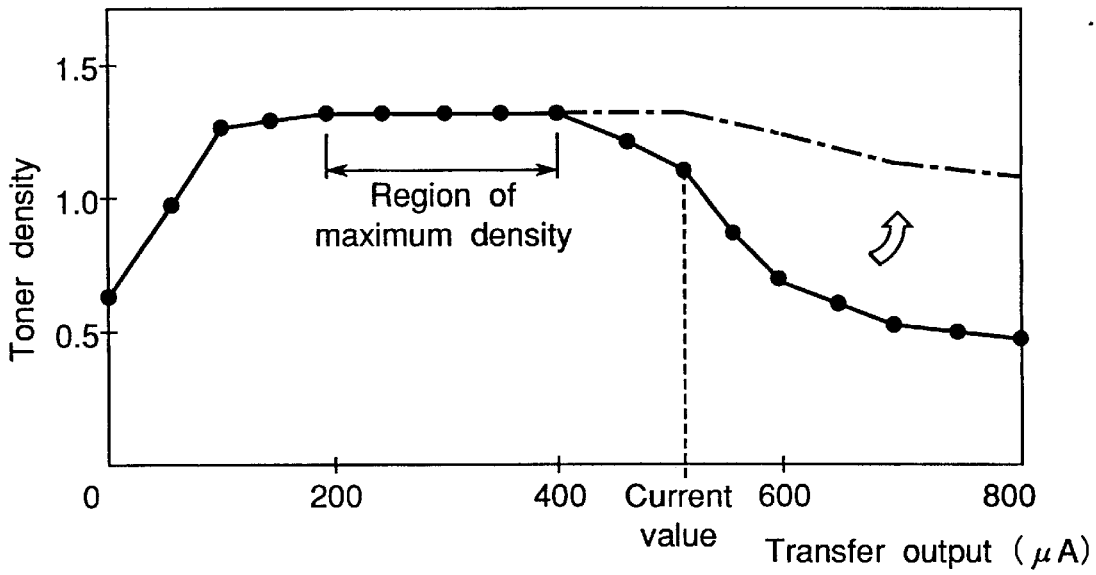
FIG. 16 is a graph of toner density plotted against transfer output.

By controlling the grid voltage of the pretransfer charger as described above, the toner charges are enhanced, and it is prevented that the toners are charged with the reverse polarity at the transfer section to remain on the photoconductor drum 23 even when the transfer output is high. Then, as shown as a dot and dashed line in FIG. 16, the relation between the transfer output and the toner density is corrected, and the transfer efficiency becomes stable irrespective of transfer output.

On the other hand, as shown in FIG. 3, the electrostatic capacitance C3 of the paper 502 is affected by the dielectric constant accompanied by the change in absolute humidity. Further, the resistance of the paper 502 is also changed by the absolute humidity. Then, the change in resistance can be detected indirectly by measuring the electrostatic capacitance C3. Then, the electrostatic capacitance C3 of the paper 502 is determined from the electrostatic capacitances $C_a$, $C_b$ and $C_c$ measured at step S2, as follows (step S6):

$$C3=(C_b^{-1}+C_a^{-1})^{-1}. \quad (5)$$

Figure 17:
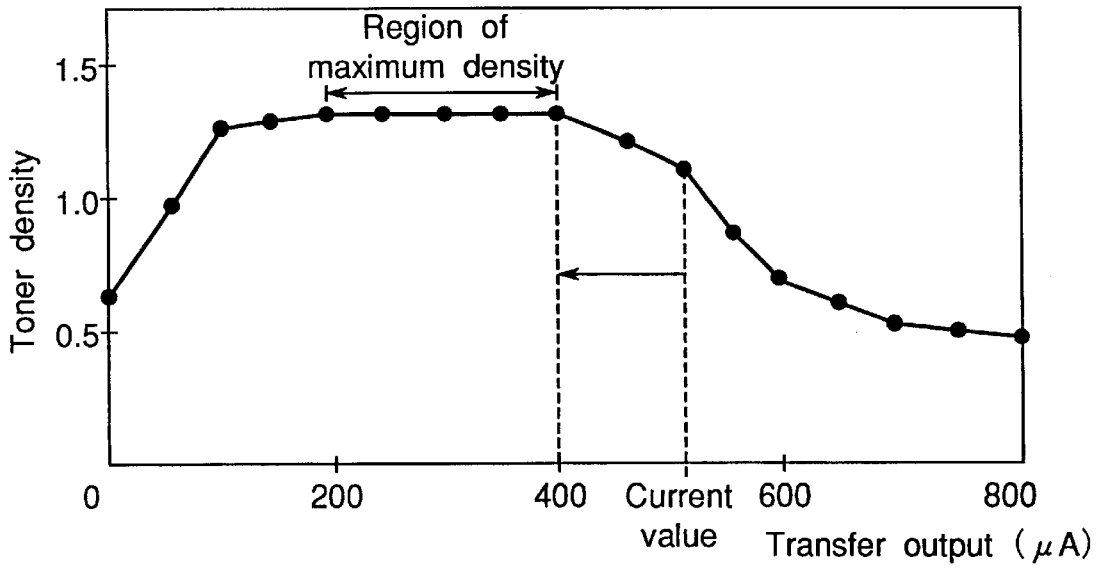
FIG. 17 is a graph of toner density plotted against transfer output.

If the obtained capacitance C3 is equal to or larger than a reference value $C3_{ref}$ (YES at step S7), the high voltage power supply 212 is controlled so that the voltage applied to the transfer roller 38 is decreased by a predetermined value from the current value (step S8), as shown with an arrow in FIG. 17. Specifically the transfer output shown in Table 1 on the relation between the absolute humidity and the transfer output is shifted by one step towards smaller values. For example, the transfer output in correspondence to the absolute humidity is decreased by 0.2 in the whole table. On the other hand, if the obtained capacitance C3 is smaller than a reference value $C3_{ref}$ (NO at step S7), the processing ends.

Next, a digital full color copying machine of a second embodiment of the invention is explained. The second embodiment is different from the first one only on the processing executed by the CPU 14 when the key for adjustment is pressed in the operational panel 50.

The processing is similar to the counterpart in the first embodiment, but it is different on the formation of standard toner patterns (in correspondence to step S1 in FIG. 12). Therefore, the timings for measuring the electrostatic capacitances (in correspondence to step S2 in FIG. 12) and the formulas for determining the electrostatic capacitances C2 and C3 of the toner layer and the paper 502 are different. The output control of the pretransfer charger 31 and the transfer roller 38 based on the measured capacitances C2 and C3, is the same as in the first embodiment. Differences of this embodiment from the first embodiment are explained below.

Figure 18:
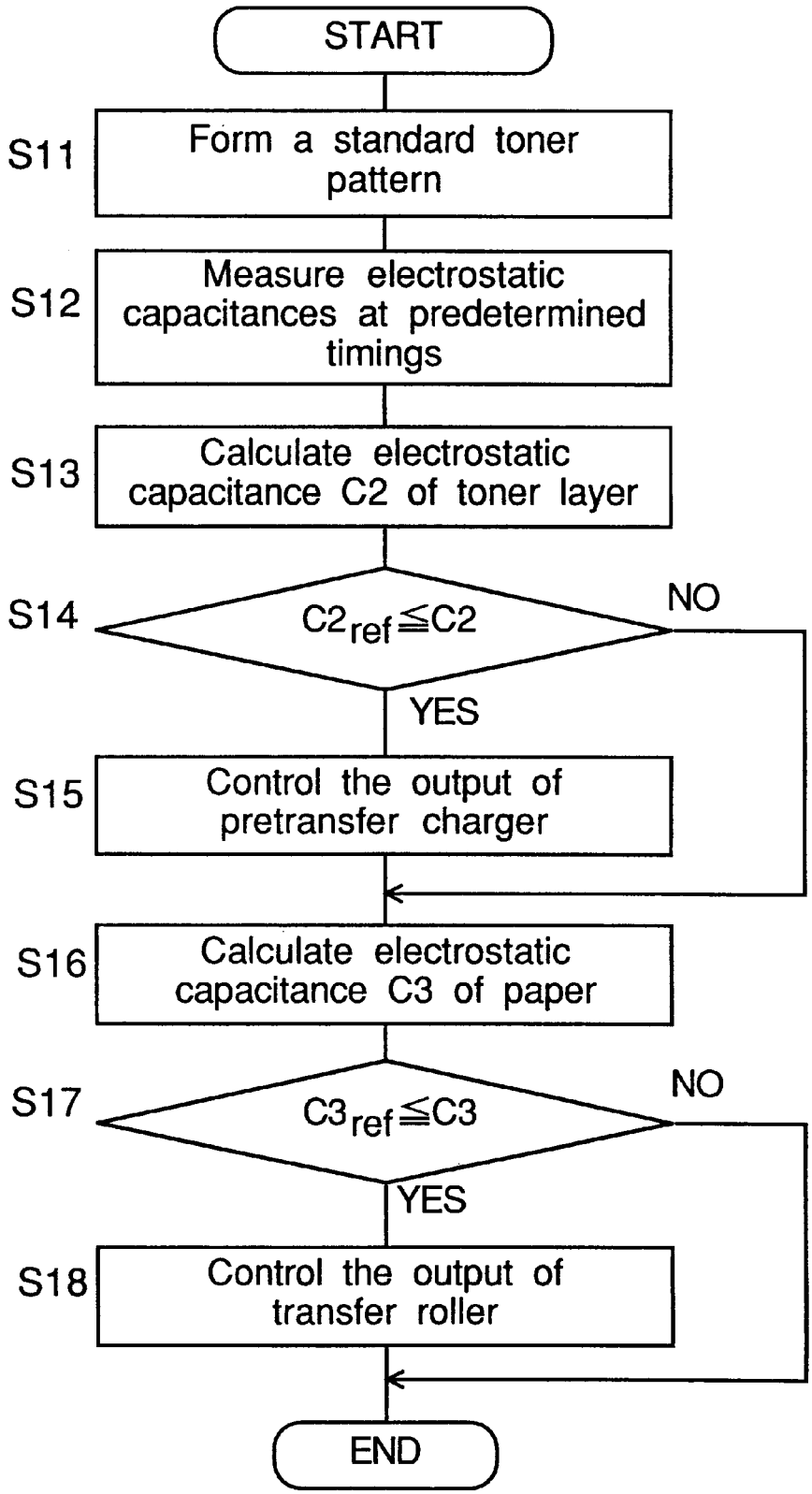
FIG. 18 is a flowchart for transfer output adjustment in a second embodiment.
Figure 19A:
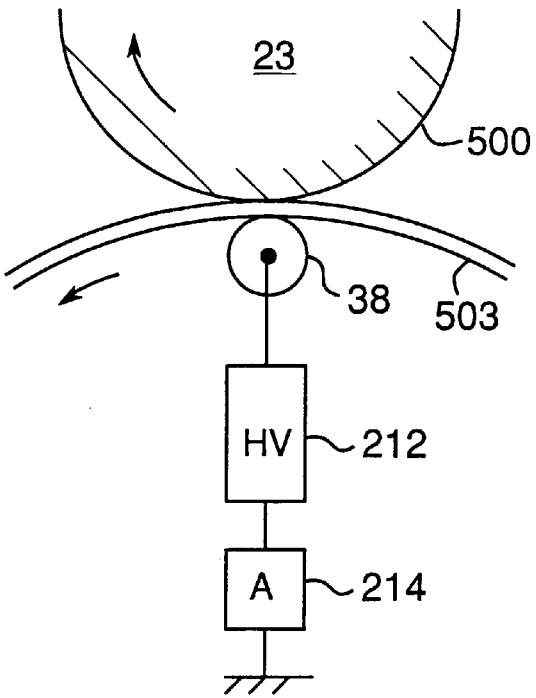
FIG. 19A is a diagram of a situation where a paper does not yet reach to the transfer section or only a transfer film exists between a transfer roller and a photoconductor drum.
Figure 19B:
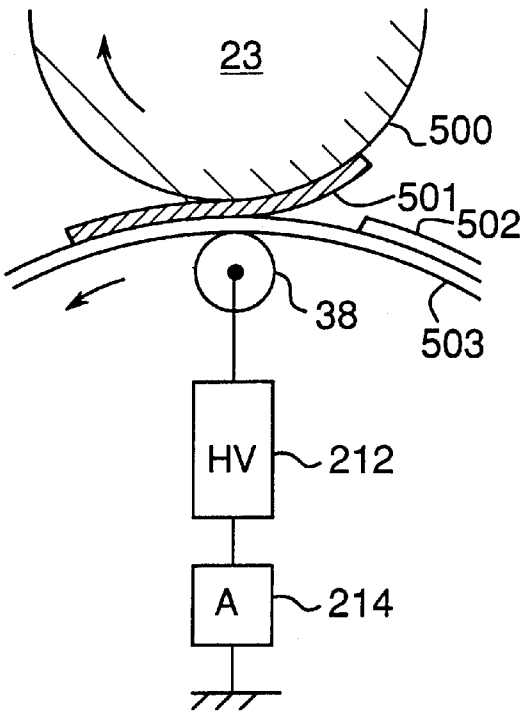
FIG. 19B is a diagram of a situation where a toner layer exists between the transfer roller and the photoconductor drum.
Figure 19C:
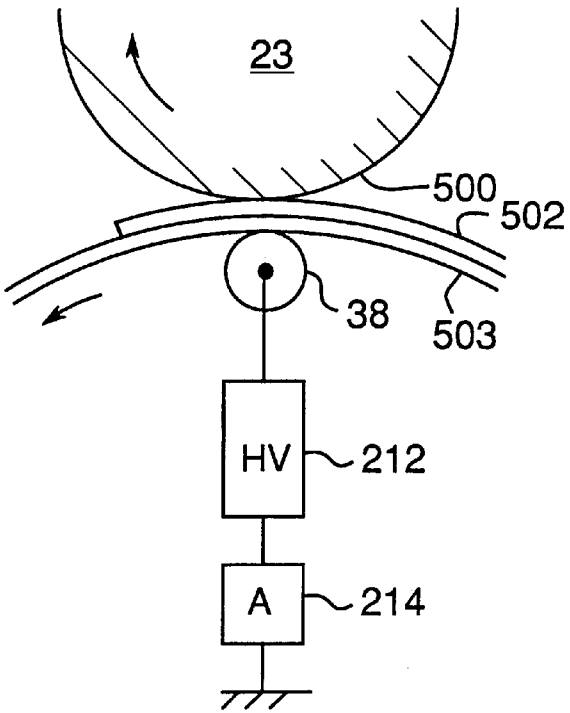
FIG. 19C is a diagram of a situation where a paper exists between the transfer roller and the photoconductor drum.

FIG. 18 shows a flowchart of the processing executed by the CPU 14 when the key for adjustment is pressed in the operational panel 50. First, a toner image is formed on the photoconductor drum 23 in predetermined conditions of laser exposure intensity, grid voltage and development bias voltage (step S11). Then, the toner image is transferred directly onto the transfer film, and the electrostatic capacitance is measured at the three timings shown in FIGS. 19A–19C according to the currents measured with the ammeter 214 (step S12). FIG. 19A shows a situation where the paper 502 does not yet reach to the transfer section or only the transfer film 503 exists between the transfer roller 38 and the photoconductor drum 23. FIG. 19B shows a situation where the toner layer 501 and the transfer film 503 exist between the transfer roller 38 and the photoconductor drum 23. FIG. 19C shows a situation where the paper 502 and the transfer film 503 exist between the transfer roller 38 and the photoconductor drum 23. In the situation shown in FIG. 19A, the capacitance $C'_a$ of the photoconductor dielectric layer 500 and the transfer film 503 connected in series is measured. In the situation shown in FIG. 19B, the capacitance $C'_b$ of the photoconductor dielectric layer 500, the toner layer 501 and the transfer film 503 connected in series is measured. In the situation shown in FIG. 19C, the capacitance $C'_c$ of the photoconductor dielectric layer 500, the paper 502 and the transfer film 503 connected in series is measured. If C1, C2, C3 and C4 represent the capacitances of the photoconductor dielectric layer 500, the toner layer 501, the paper 502 and the transfer film 503, as in the first embodiment, the above-mentioned capacitances $C'_a$, $C'_b$ and $C'_c$ satisfy following relations:

$$C'_a{}^{-1}=C_1^{-1}+C_4^{-1}=C_a^{-1}, \quad (6)$$

$$C'_b{}^{-1}=C_1^{-1}+C_2^{-1}+C_4^{-1}, \quad (7)$$

and $$C'_c{}^{-1}=C_1^{-1}+C_3^{-1}+C_4^{-1}=C_b^{-1}. \quad (8)$$

Then, the electrostatic capacitance C2 of the toner layer 501 is calculated from the Eqs. (6) and (7) as follows (step S13):

$$C2=(C'_b{}^{-1}-C'_a{}^{-1})^{-1}. \quad (9)$$

If the obtained electrostatic capacitance C2 of the toner layer 501 is equal to or larger than a reference value $C2_{ref}$ (YES at step S14), the toners are decided to be deteriorated, and the toner charges before transfer are determined to have low. Then, the grid voltage of the pretransfer charger 31 is increased by a predetermined value from the normal value to enhance the toner charges (step S15). On the other hand, if the obtained electrostatic capacitance C2 of the toner layer 501 is smaller than the reference $C2_{ref}$ (NO at step S14), the grid voltage of the pretransfer charger 31 is not controlled, and the flow proceeds to a next step.

Next, the electrostatic capacitance C3 of the paper 502 is calculated from Eqs. (6) and (8) as follows (step S16):

$$C3=(C'_c{}^{-1}-C'_a{}^{-1})^{-1}. \quad (10)$$

If the obtained electrostatic capacitance C3 is equal to or larger than a reference value $C3_{ref}$ (YES at step S17), the resistance of the paper is determined to have become low, and the reverse charging is liable to happen. Then, the voltage applied to the transfer roller 38 is decreased by a predetermined value from the normal value (step S18). On the other hand, if the obtained electrostatic capacitance C3 is smaller than the reference $C3_{ref}$ (NO at step S17), the voltage applied to the transfer roller 38 is not controlled, and the flow ends.

Next, a digital full color copying machine of a third embodiment of the invention is explained. Differences of this embodiment from the first embodiment are explained here.

Figure 20:
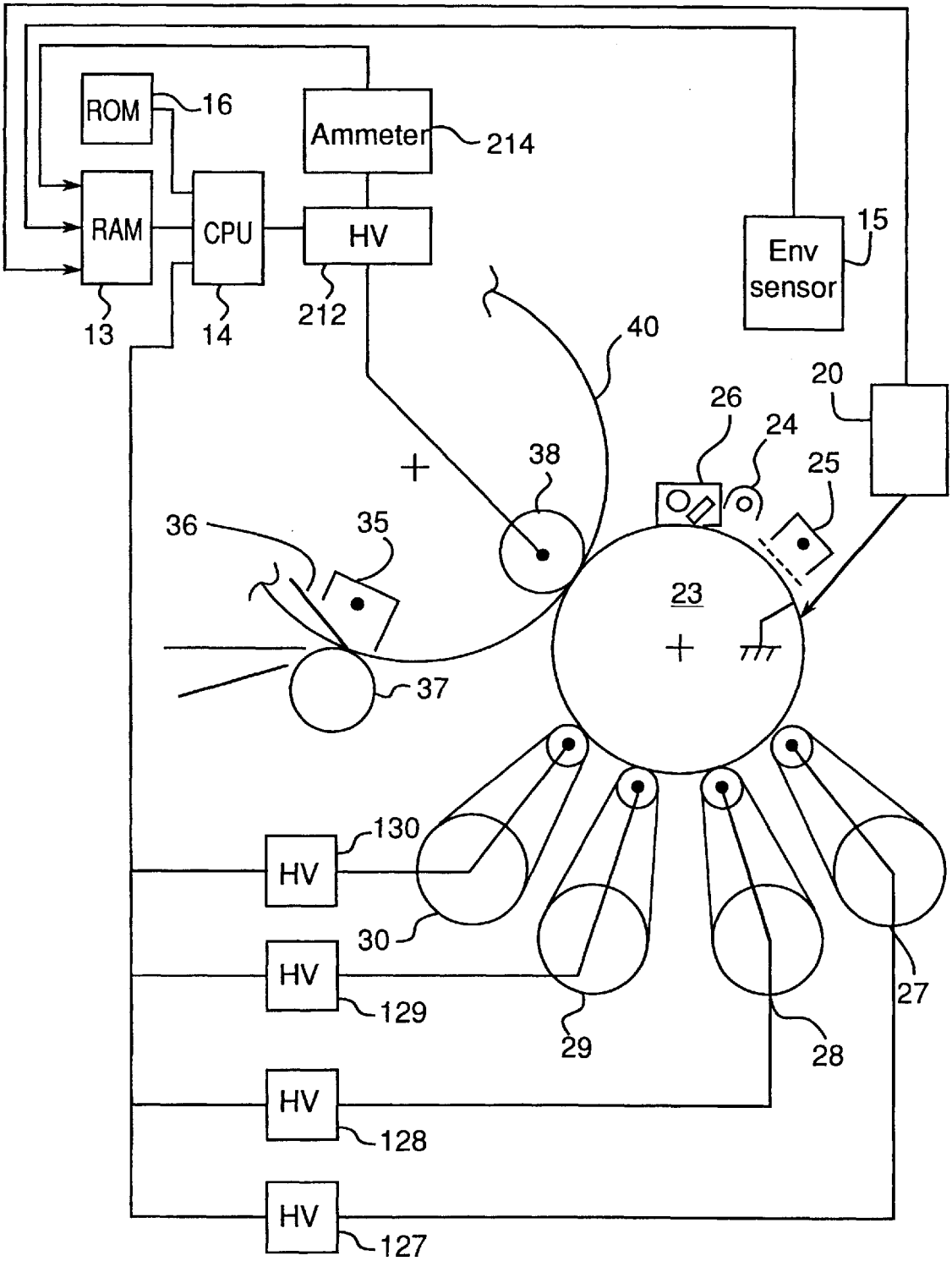
FIG. 20 is a schematic diagram of a structure around the photoconductor drum and the transfer drum in the copying machine.

FIG. 20 shows in detail a structure around the photoconductor drum 23 and the transfer drum 40 in the copying machine and a control system therefor. The CPU 14 is connected to the ROM 16, the RAM 13 and high voltage power supplies 127–130 and 212. The high voltage power supply 212 applies a voltage to the transfer roller 38. Further, the high voltage power supplies 127–130 supply development bias voltages to the surfaces of sleeves of the toner development units 27–30 for cyan, magenta, yellow and black. The voltages generated by the high voltage power supplies 127–130 have a sine wave superposed on a dc voltage. The pretransfer charger 31 used in the first embodiment is omitted in this embodiment. The CPU 14 controls the dc voltage according to the electrostatic capacitance of the standard toner layer determined from the current detected by the ammeter 214. The default sine wave to be superposed on the dc voltage has peak-to-peak voltage $V_{p-p}$ of 2 kV and frequency f of 4 kHz.

When the key for adjustment is pressed in the operational panel 50, the electrostatic capacitance of toners is determined from the current flowing through the transfer section, and it is decided based on the current whether or not the amount of charges of toners before transfer has become low.

If the toner charges are smaller than an appropriate value, the high voltage power supplies 127–130 are controlled so that the peak-to-peak voltage $V_{p\text{-}p}$ of the sine wave of the development bias voltage is decreased from 2.0 to 1.5 kV. Thus, the amount of toners remaining after transfer due to reverse charging can be decreased.

Figure 21:
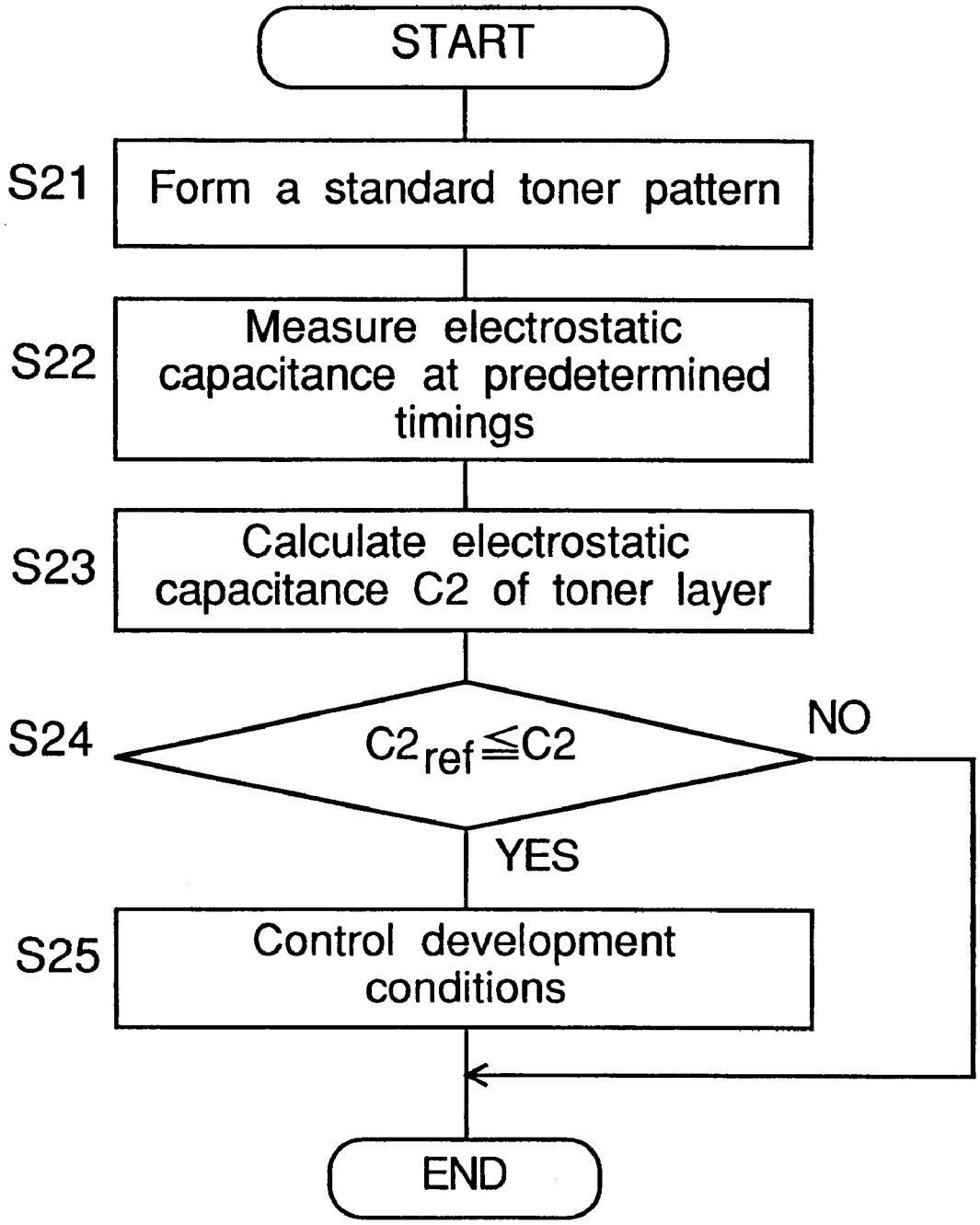
FIG. 21 is a flowchart for transfer output adjustment in a third embodiment.

FIG. 21 shows a flowchart of the processing executed by the CPU 14 when the key for adjustment is pressed in the operational panel 50. The processing is explained in detail with reference to the flowchart and relevant drawings. First, a standard toner pattern is formed on the photoconductor drum 23 at position in correspondence to a second half of a paper fed to the transfer drum 40 with predetermined laser exposure intensity, grid voltage and development bias voltage (step S21). Then, the transfer roller 38 starts to apply a predetermined voltage just before the top end of the paper wound on the transfer drum reaches the transfer section and stops applying the voltage after the bottom end of the paper passes the transfer section, and the electrostatic capacitance is determined at the three timings shown in FIGS. 13A–13C according to the currents measured with the ammeter 214 (step S22). In this apparatus, the transfer film 503 is made of an insulating film of volume resistance of $10^{14}$–$10^{15}$ Ω·cm. Therefore, when a voltage is applied to measure the current, charges are moved only due to polarization of each phase, and free charges do not flow substantially. Therefore, the total electrostatic capacitance for capacitors of the layers connected in series can be determined from the measured currents. Thus, the electrostatic capacitance C2 of the toner layer 501 is determined according to Eq. (4) by using the electrostatic capacitances measured at step S22 (step S23).

If the obtained electrostatic capacitance C2 of the toner layer 501 is equal to or larger than a reference value $C2_{ref}$ (=20 pf) (YES at step S24), the charges of developed toners (just before transfer) is low and the toners are liable to be charges with the reverse polarity by the transfer output or to be remained on the photoconductor drum 23. Then, the high voltage power supplies 127–130 are controlled so that the peak-to-peak voltage $V_{p\text{-}p}$ of the sine wave of the development bias voltage is decreased from 2.0 to 1.5 kV (step S25). If the obtained electrostatic capacitance C2 of the toner layer 501 is smaller than the reference $C2_{ref}$ (NO at step S24), the development conditions are not controlled, and the processing ends.

By controlling the development conditions as explained above, the amount of charges of toners before transfer is increased, and even if the transfer output is high, it is prevented that toners are charged with the reverse polarity at the transfer section and that toners remain on the photoconductor drum 23 after passing the transfer section. Then, the relation between the transfer output and the toner density is corrected as shown with a dot and dashed line in FIG. 16. Therefore, the transfer efficiency is stabilized irrespective of the transfer output.

Next, a digital full color copying machine of a fourth embodiment of the invention is explained. This embodiment is similar to the third embodiment. The processing when the key for adjustment is pressed is similar to the counterpart in the third embodiment, but the formation of a standard toner pattern (in correspondence to step S21 in FIG. 21) is different. Therefore, the timings for measuring the electrostatic capacitance (in correspondence to step S22 in FIG. 21) and the formula for determining the electrostatic capacitance C2 of the toner layer 501 is different. The output control of the peak-to-peak voltage $V_{p\text{-}p}$ of the sine wave of the development bias voltage based on the measured capacitance C2 is the same as in the third embodiment. Only the differences of this embodiment from the first embodiment are explained below.

Figure 22:
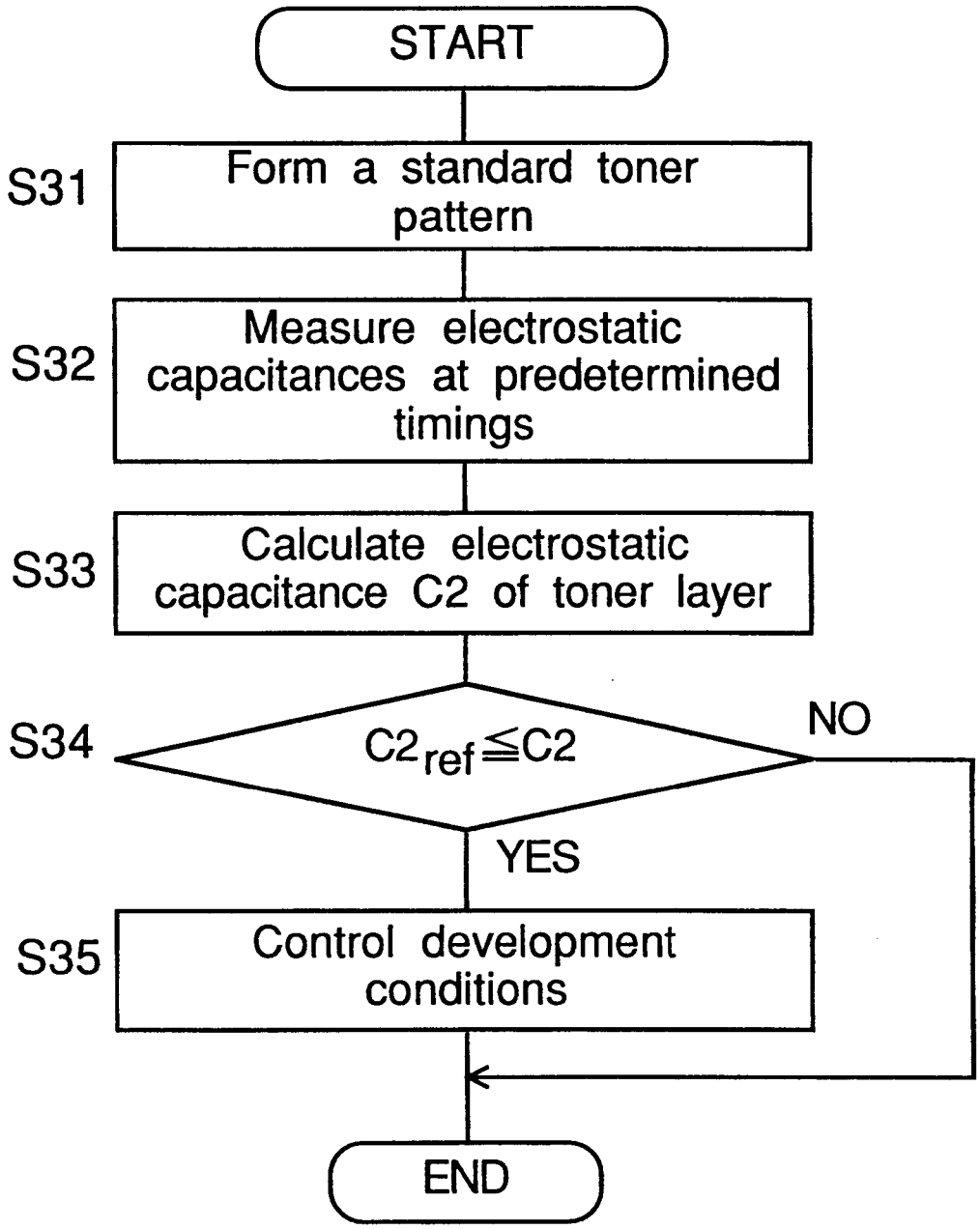
FIG. 22 is a flowchart for transfer output adjustment in a fourth embodiment.

FIG. 22 shows a flowchart of the processing executed by the CPU 14 when the key for adjustment is pressed in the operational panel 50. First, a standard toner pattern is formed on the photoconductor drum 23 with predetermined laser exposure intensity, grid voltage and development bias voltage (step S31). Next, the standard toner pattern is transferred directly onto the transfer drum, and the electrostatic capacitance is measured at the three timings shown in FIGS. 19A–19C according to the currents measured with the ammeter 214 (step S32). Next, the electrostatic capacitance C2 of the toner layer 501 is calculated according to Eqs. (6)–(9) (step S33). If the obtained electrostatic capacitance C2 of the toner layer 501 is equal to or larger than a reference value $C2_{ref}$ (YES at step S34), toners are deteriorated, and the charges of developed toners just before transfer is low. Then, the high voltage power supplies 127–130 are controlled so that the peak-to-peak voltage $V_{p\text{-}p}$ of the sine wave of the development bias voltage is decreased from 2.0 to 1.5 kV (step S35). On the other hand, if the obtained electrostatic capacitance C2 of the toner layer 501 is smaller than the reference $C2_{ref}$ (NO at step S34), the development conditions are not controlled, and the processing ends.

In this apparatus, the peak-to-peak voltage of the sine wave of the development bias voltage is controlled as a development condition in this apparatus. However, as shown in the graph of the relation between the frequency and the toner charges before transfer in FIG. 7, the frequency can be controlled instead of the peak-to-peak voltage to obtain similar advantages. Further, the pulse wave having a pause time as shown in FIG. 8 may also be used for the development bias voltage, and the pulse time or the pause time of the pulse wave may be controlled. That is, the toner charges may be increased by increasing the pause time as shown in the graph of the relation between the pause time and the toner charges in FIG. 9, or the toner charges may be increased by decreasing the pulse time as shown in the graph of the relation between the pulse time and the toner charges in FIG. 10.

In the first to fourth embodiments, the transfer roller 38 is used for transferring the toner image. However, a transfer brush may also be used to have similar advantages. A transfer belt may also be used instead of the transfer drum 40.

Figure 23:
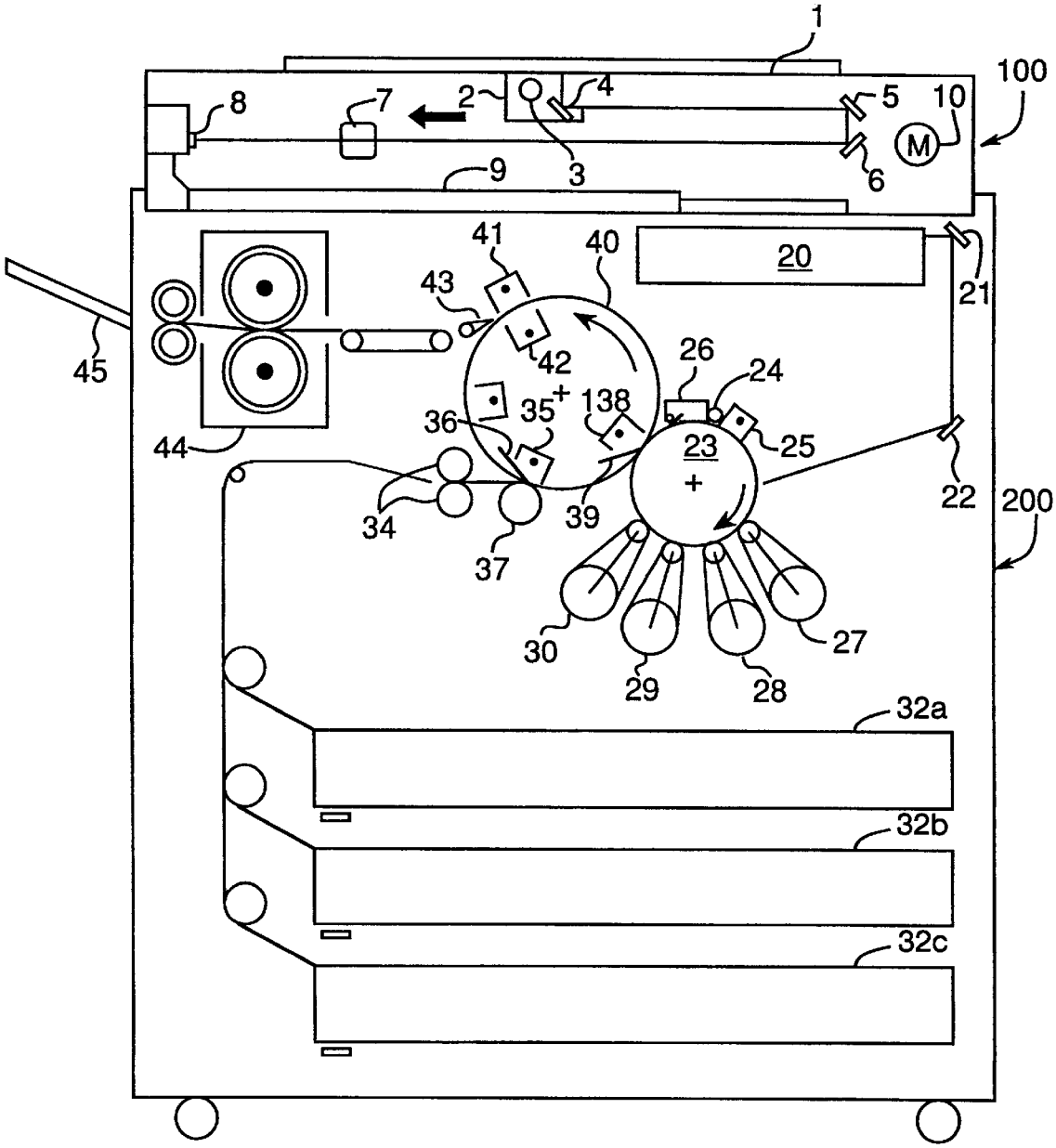
FIG. 23 is a schematic sectional view of a digital full color copying machine of a fifth embodiment of the invention.

Next, a digital full color copying machine of a fifth embodiment of the invention is explained. FIG. 23 shows a schematic sectional view of a digital full color copying machine of a fifth embodiment of the invention. This copying machine is similar to that of the first embodiment shown in FIG. 1, but a transfer charger 138 is used instead of the transfer roller 38.

Figure 24:
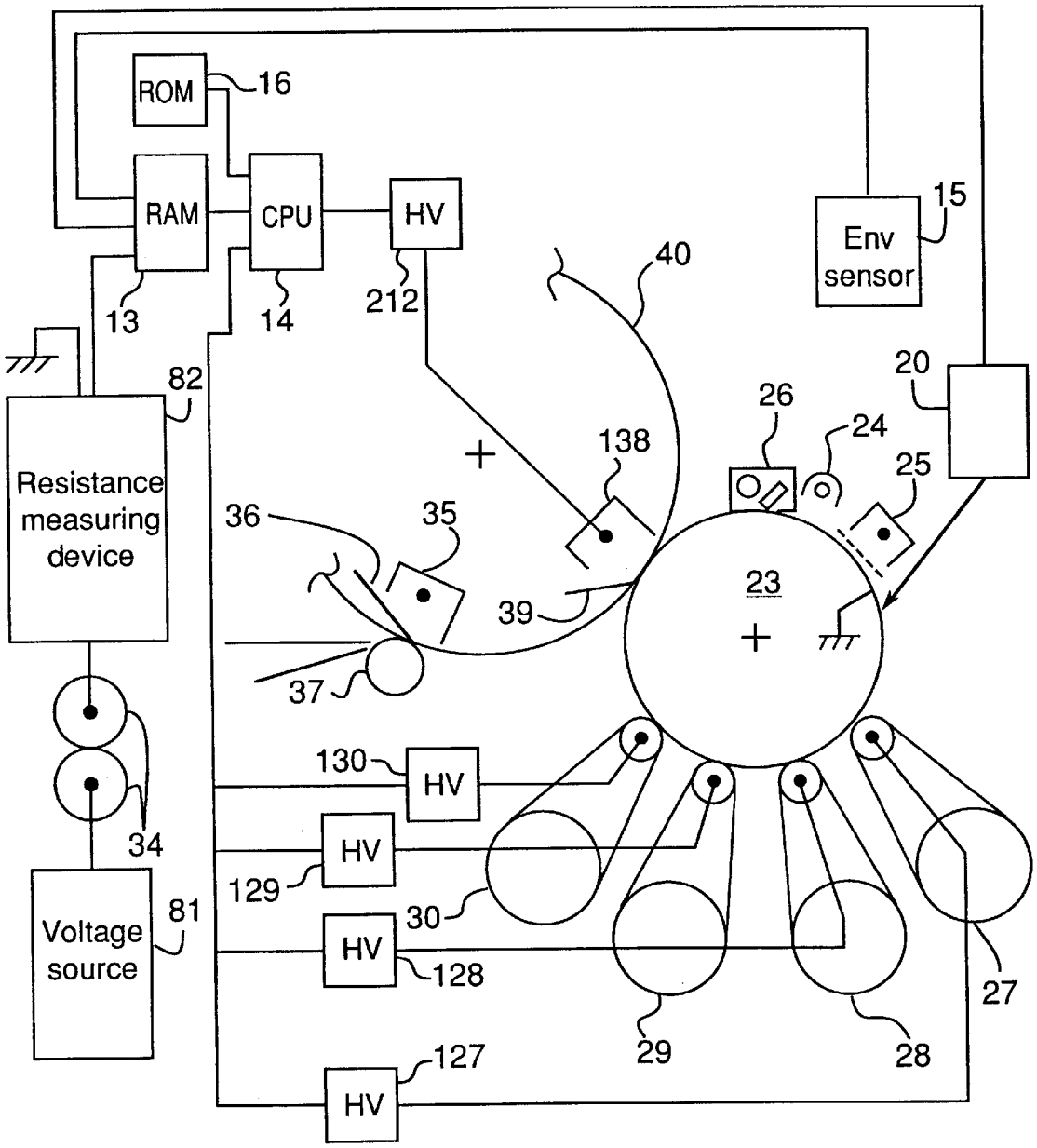
FIG. 24 is a schematic diagram of a structure around a photoconductor drum and a transfer drum in the copying machine.

FIG. 24 is a schematic diagram of a structure around a photoconductor drum 23 and a transfer drum 40 in the copying machine. This structure is similar to the counterpart of the third embodiment shown in FIG. 20. As mentioned above, the transfer charger 138 is provided for transferring a toner image. Further, a press member 39 is provided to press the transfer drum 40 toward the photoconductor drum 23 in order to increase contact between the paper and the photoconductor drum 23 and to improve transfer. The resistance of a paper is measured by a resistance measuring device 82. A voltage source 81 applies a voltage to one of the timing rollers 34 while a paper passes through the timing rollers 34, and the resistance measuring device 82 measures a current flowing through the timing rollers and the paper and determines a resistance of the paper according to the measured current and the applied voltage. The obtained resistance is sent through the RAM 13 to the CPU 14.

The CPU 14 detects absolute humidity of the printer 200 with an environment sensor 15, and changes the transfer output to keep the transfer efficiency constant. Table 3 shown below is a control table stored in the ROM 16 for determining the transfer output in correspondence to the absolute humidity detected with the environment sensor 15. The control table is used when a full color image is formed. As shown in Table 3, the transfer output is set so as to increase with decreasing absolute humidity on the basis of experimental data. For each section of absolute humidity, the transfer output is increased successively from the first color to the fourth color. This takes into account an effect of charge-up of transfer film due to the output of a previous color.

TABLE 3

| | Transfer output | | | |
|---|---|---|---|---|
| | Transfer output ($\mu$/A) | | | |
| Absolute humidity ($g/m^3$) | First color (cyan) | Second color (magenta) | Third color (yellow) | Fourth color (black) |
| 0–5 | 550 | 600 | 650 | 700 |
| 6–10 | 500 | 550 | 600 | 650 |
| 11–15 | 450 | 500 | 550 | 600 |
| 16–20 | 400 | 450 | 500 | 550 |
| 21–25 | 350 | 400 | 450 | 500 |
| 26–30 | 300 | 350 | 400 | 450 |

Figure 25:
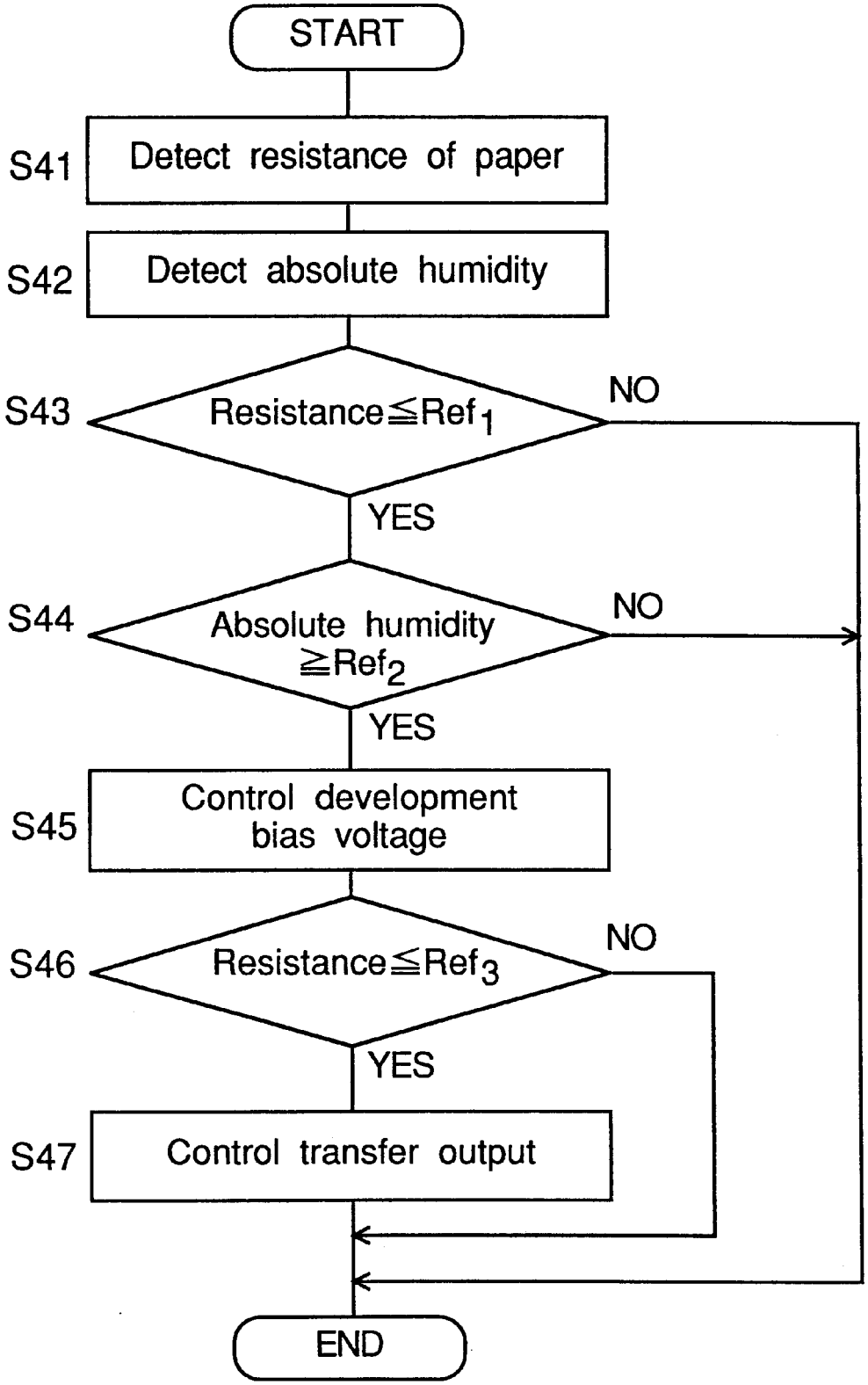
FIG. 25 is a flowchart for transfer output adjustment in the fifth embodiment.

FIG. 25 is a flowchart for controlling the development conditions and transfer conditions in the fifth embodiment. First, the resistance of the paper fed from the cassette is detected with the resistance measuring device 82 (step S41). Next, the absolute humidity is measured with the environment sensor 15 (step S42). If the obtained resistance of the paper is smaller than or equal to a first reference value $Ref_1$, for example $10^8$ Ω·cm (YES at step S43), and if the obtained absolute humidity of the paper is larger than or equal to a second reference value $Ref_2$, for example 26 $g/m^3$ (YES at step S44), the high voltage power supplies 127–130 are controlled so that the peak-to-peak voltage $V_{p-p}$ of the sine wave of the development bias voltage is decreased from the default value 2.0 kV to 1.5 kV (step S45). By decreasing the peak-to-peak voltage $V_{p-p}$ (FIG. 6), the toner charges after development before transfer are increased, and the amount of toners remaining on the photoconductor drum 23 is decreased after passing the transfer section.

Figure 26:
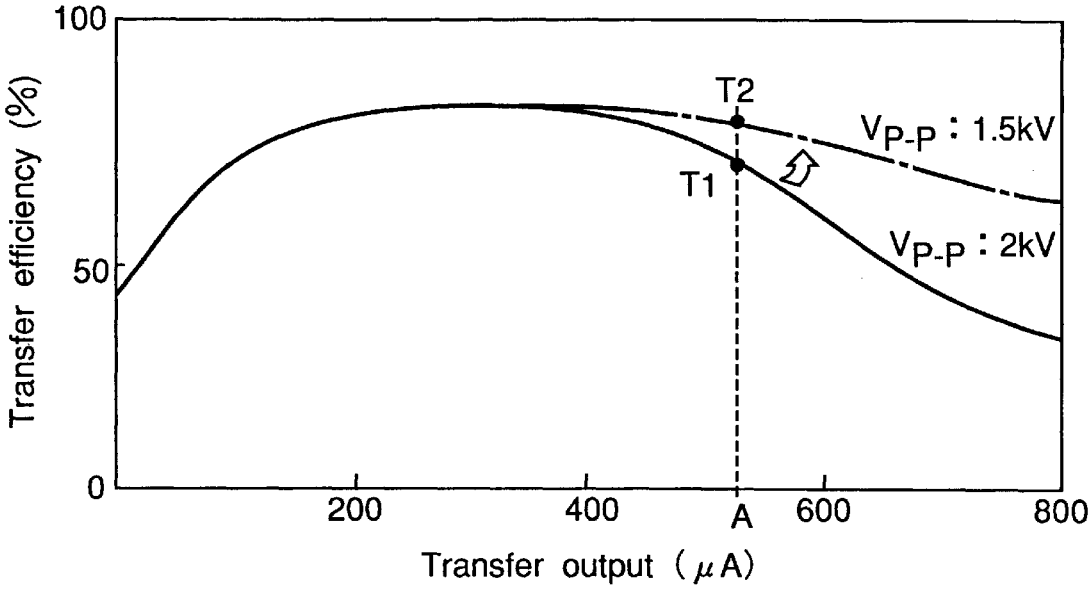
FIG. 26 is a graph of the transfer efficiency $\eta$ plotted against transfer output.

FIG. 26 shows a graph of the transfer efficiency η (%) plotted against transfer output from 0 to 800 $\mu$A, wherein a solid line represents the transfer efficiency for $V_{p-p}$ of 2 kV and a dot and dashed line represents the transfer efficiency for $V_{p-p}$ of 1.5 kV. When $V_{p-p}$ is decreased at step S45, the transfer efficiency at high transfer outputs is decreased as shown in FIG. 26. For example, if the transfer output is "A", the transfer efficiency is increased from T1 to T2.

Figure 27:
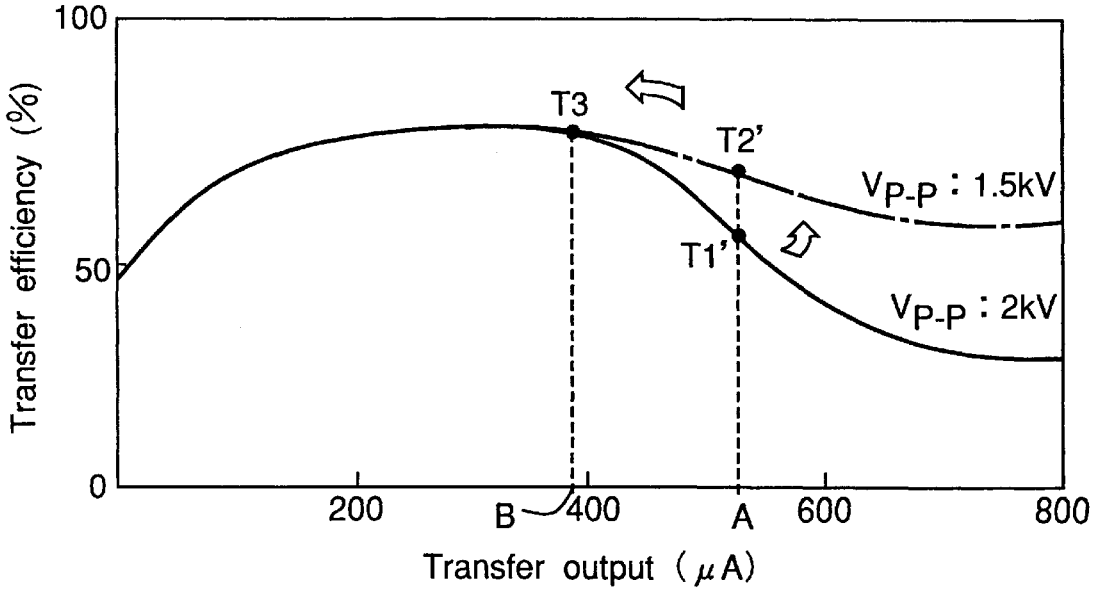
FIG. 27 is a graph of the transfer efficiency $\eta$ plotted against transfer output.

However, even when the transfer efficiency is adjusted as mentioned above, if the resistance of the paper becomes low, the transfer efficiency does not become sufficiently high. Then, if the resistance of the paper is equal to or smaller than a third reference value $Ref_3$ (YES at step S46) , the transfer output is decreased (step S47). FIG. 27 shows a graph of the transfer efficiency η (%) plotted against transfer output from 0 to 800 $\mu$A when the resistance of the paper is equal to or less than $Ref_3$. In FIG. 27, a solid line represents the transfer efficiency for $V_{p-p}$ of 2 kV and a dot and dashed line represents the transfer efficiency for $V_{p-p}$ of 1.5 kV. The transfer efficiency at high transfer outputs is increased more than the data shown in FIG. 26. For example, if the transfer output is "A", the transfer efficiency is increased from T1'0 to T2' by decreasing the $V_{p-p}$ to 1.5 kV. However, the transfer efficiency T2' is smaller than the maximum transfer efficiency. Then, as explained above, in order to realize the optimum transfer efficiency, the transfer output determined according to the control table based on the absolute humidity is decreased by a predetermined amount according to the absolute humidity detected at step S42.

In this apparatus, the peak-to-peak voltage of the sine wave of the development bias voltage is controlled as a development condition in this apparatus. However, as shown in the graph of the relation between the frequency and the toner charges before transfer in FIG. 7, the frequency can be controlled instead of the peak-to-peak voltage to obtain similar advantages. Further, the pulse wave having a pause time as shown in FIG. 8 may also be used for the development bias voltage, and the pulse time or the pause time of the pulse wave may be controlled. That is, the toner charges may be increased by increasing the pause time as shown in the graph of the relation between the pause time and the toner charges in FIG. 9, or the toner charges may be increased by decreasing the pulse time as shown in the graph of the relation between the pulse time and the toner charges in FIG. 10. This also holds for a sixth embodiment to be explained below.

Next, a digital full color copying machine of the sixth embodiment of the invention is explained. This embodiment is similar to the fifth embodiment in that the transfer output is determined according to the control table shown in Table 2 by measuring absolute humidity with the environment sensor 15. Before starting a copy operation or when a predetermined mode is set, in order to stabilize the image density, a standard toner pattern is formed on the photoconductor drum 23, and toner charges before transfer are measured on the toner pattern. Then, the development condition such as the peak-to-peak voltage of the sine wave of the development bias voltage, and if necessary the transfer output are controlled according to the measured toner charges.

Figure 28:
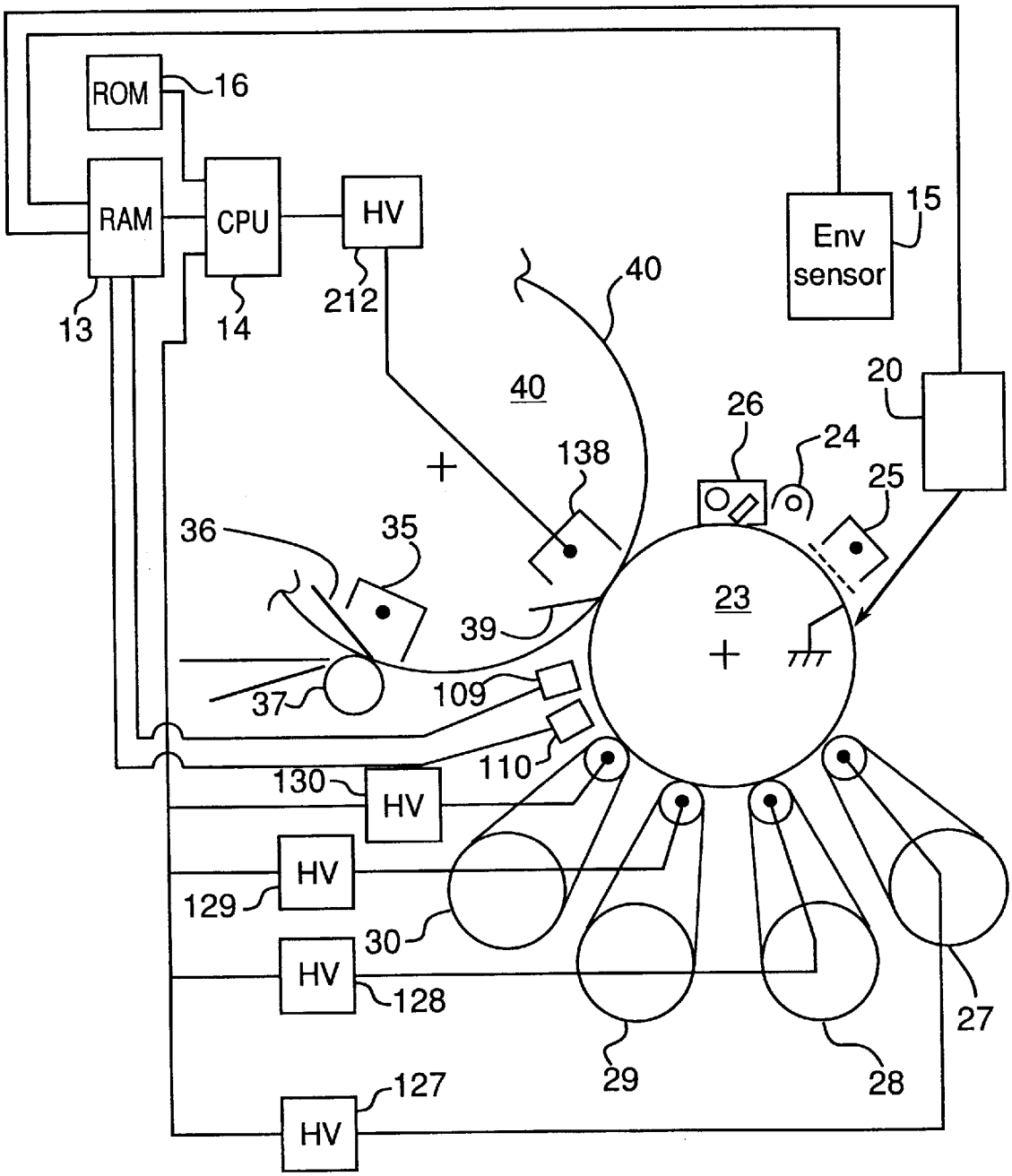
FIG. 28 is a schematic diagram of a structure around a photoconductor drum and a transfer drum in the copying machine.

FIG. 28 is a schematic diagram of a structure around a photoconductor drum 23 and a transfer drum 40 in the copying machine. This structure is similar to the counterpart of the fifth embodiment shown in FIG. 24, but two sensors 109 and 110 are provided just before the transfer section. One of the sensors 109 detects the amount of toners adhered on the photoconductor drum 23, and the other 110 detects the surface potential of the photoconductor drum 23, while the voltage source 81 and the resistance measuring device 82 are omitted.

Figure 29:
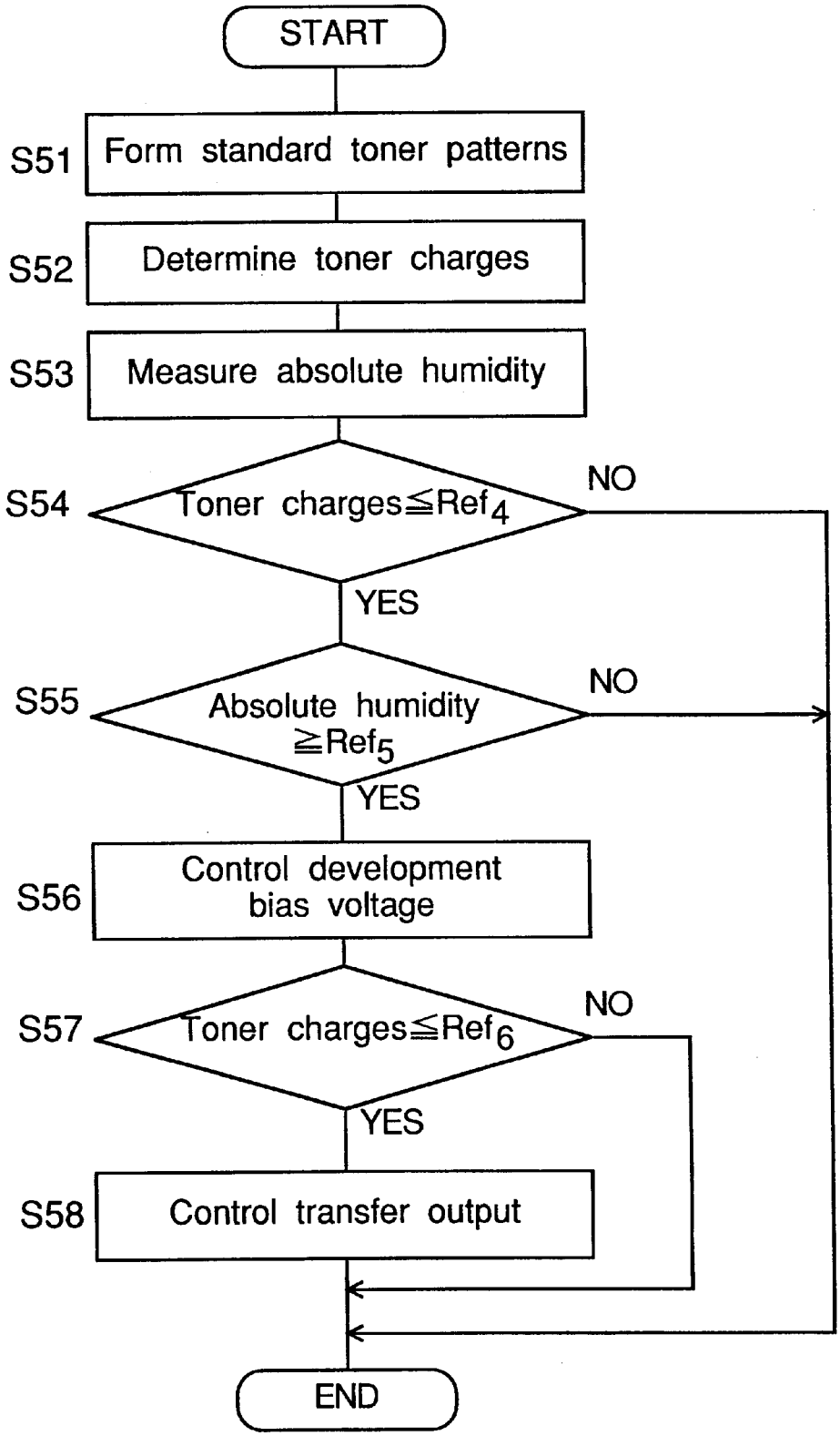
FIG. 29 is a flowchart for transfer output adjustment in a sixth embodiment.

FIG. 29 is a flowchart for transfer output adjustment in the sixth embodiment. First, a standard toner pattern is formed on the photoconductor drum (step S51). Then, the amount of adhered toners and the surface potential are measured with the sensors 109 and 110, and the toner charge per weight is determined according to the measured values (step S52). Alternatively, the development current flowing through the development sleeve of the development unit is measured, and the toner charge per weight is determined according to the development current and the adhered amount of toners measured with the sensor 109. Next, the absolute humidity is measured with the environment sensor 15 (step S53).

If the obtained toner charges is equal to or smaller than a reference value $Ref_4$, for example 15 $\mu$C/g (YES at step S54), and if the measured absolute humidity is equal to or larger than a reference value $Ref_4$, for example 26 g/m$^3$ (YES at step S55), the reverse charging of toners is liable to occur, and the transfer efficiency becomes low at the high transfer output side. Then, the high voltage power supplies 127–130 for the development bias voltages are controlled so that the peak-to-peak voltage $V_{p-p}$ of the sine wave of the development bias voltage is decreased from the default value 2.0 kV to 1.5 kV (step S56). Thus, the toner charges before transfer are increased as shown in FIG. 5, and the transfer efficiency can be increased at the high transfer output side.

By controlling the development bias voltage as explained above, the transfer will be performed sufficiently in almost all cases. However, if the toner charges becomes lower further, the transfer will not be performed sufficiently even if the peak-to-peak voltage is adjusted, as explained above with reference to FIG. 27. Then, if the toner charges determined at step S51 is smaller than or equal to a reference value $Ref_6$, such as 10 $\mu$C/g (YES at step S57), the transfer output is decreased by a predetermined amount according to the absolute humidity measured at step S53 (step S58). Then, the transfer efficiency is improved, and the optimum transfer efficiency is realized.

As mentioned above, the amount of toner charges is monitored before transfer for controlling the development condition (the development bias voltage). On the contrary, if the amount of toner charges is detected after transfer, the amount of toner charges is affected by the reverse charging. The amount of toner charges can be detected precisely by monitoring before transfer, and the detected amount can be fed back precisely for controlling the development condition.

In the fifth and sixth embodiments explained above, the transfer charger 138 is used. Alternately, a transfer brush or a transfer roller may be used. Further, a transfer belt may be used instead of the transfer drum 40.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. An image forming apparatus comprising:

a photoconductor;

a development device for developing a latent image on said photoconductor to form a toner image;

a transfer device, opposing said photoconductor, for transferring the toner image from said photoconductor onto a paper passing between said photoconductor and said transfer device;

a measuring device for measuring a resistance of the paper; and a controller for controlling a development condition of said development device according to the resistance measured by said measuring device.

2. An image forming apparatus according to claim 1, wherein the development condition is a development bias voltage applied to said development device.

3. An image forming apparatus comprising:

a photoconductor;

a development device for developing a latent image on said photoconductor to form a toner image;

a transfer device, opposing said photoconductor, for transferring the toner image from said photoconductor onto a paper passing between said photoconductor and said transfer device;

a measuring device for measuring a resistance of the paper;

a humidity sensor; and a controller for controlling image forming conditions of said image forming apparatus according to the resistance of the paper measured by said measuring device and the humidity measured by said humidity sensor.

4. An image forming apparatus according to claim 3, wherein the image forming conditions comprise a transfer condition of the transfer device.

5. An image forming apparatus according to claim 4, wherein the transfer condition is a transfer voltage of said transfer device.

6. A method for forming an image in an electrophotographic process, said method comprising the steps of:

forming a latent image on a photoconductor;

developing the latent image on the photoconductor with a development device to form a toner image;

transferring the toner image from the photoconductor onto a paper passing between the photoconductor and a transfer device opposing the photoconductor;

measuring a resistance of the paper; and controlling a development condition of said development device according to the thus measured resistance of the paper.

7. A method according to claim 6, wherein the development condition is a development bias voltage applied to said development device.

8. A method for forming an image in an electrophotographic process, said method comprising the steps of:

forming a latent image on a photoconductor;

developing the latent image on the photoconductor with a development device to form a toner image;

transferring the toner image from the photoconductor onto a paper passing between the photoconductor and a transfer device opposing the photoconductor;

measuring a resistance of the paper;

measuring humidity of ambient environment; and controlling image forming conditions according to the thus measured resistance of the paper and the thus measured humidity.

9. A method according to claim 8, wherein the image forming conditions comprise a transfer condition of the transfer device.

10. A method according to claim 9, wherein the transfer condition is a transfer voltage of the transfer device.

11. An image forming apparatus comprising:

a photoconductor;

a development device for developing a latent image on the photoconductor to form a toner image;

a transfer device for transferring the toner image on the photoconductor onto a paper;

a first measuring device for measuring resistance of the paper;

a second measuring device for measuring absolute humidity;

a first comparator for comparing the resistance of the paper, as measured with the first measuring device, with a first standard resistance;

a second comparator for comparing the absolute humidity, as measured with the second measuring device, with a standard absolute humidity; and a first controller for decreasing a peak-to-peak voltage of a sine wave superposed with a development bias voltage of the development device if the first comparator decides that the resistance of the paper is smaller than or equal to the first standard resistance and if the second comparator decides that the absolute humidity is larger than or equal to the standard absolute humidity.

12. An image forming apparatus according to claim 11, further comprising:

a third comparator for comparing the resistance of the paper, as measured with the first measuring device, with a second standard resistance smaller than the first standard resistance; and a second controller for decreasing a transfer output of the transfer device if the third comparator decides that the resistance of the paper is smaller than or equal to the second standard resistance.

13. A method for forming an image comprising the steps of:

forming a latent image on a photoconductor;

developing the latent image with a development device to form a toner image;

transferring the toner image on the photoconductor with a transfer device onto a paper carried between the photoconductor and the transfer device;

measuring resistance of the paper;

measuring absolute humidity;

comparing the thus measured resistance of the paper with a first standard resistance;

comparing the absolute humidity with a standard absolute humidity; and controlling a development bias voltage of the development device if the resistance of the paper is smaller than or equal to the first standard resistance and the absolute humidity is larger than or equal to the standard absolute humidity.

14. A method according to claim 13, further comprising the steps of:

comparing the resistance of the paper with a second standard resistance smaller than the first standard resistance; and decreasing a transfer output of the transfer device if the resistance of the paper is smaller than or equal to the second standard resistance.

* * * * *